US008303298B2

(12) United States Patent
Talkington et al.

(10) Patent No.: US 8,303,298 B2
(45) Date of Patent: Nov. 6, 2012

(54) ADVANCED GAS TORCH

(75) Inventors: John E. Talkington, Lantana, TX (US); Nhyanh Duyet Nguyen, Frisco, TX (US)

(73) Assignee: Victro Equipment Company, Denton, TX (US)

( * ) Notice: Subject to any disclaimer, the term of this patent is extended or adjusted under 35 U.S.C. 154(b) by 528 days.

(21) Appl. No.: 12/419,686

(22) Filed: Apr. 7, 2009

(65) Prior Publication Data

US 2009/0253089 A1 Oct. 8, 2009

Related U.S. Application Data

(60) Provisional application No. 61/043,334, filed on Apr. 8, 2008.

(51) Int. Cl.
*F23Q 3/00* (2006.01)

(52) U.S. Cl. ..... 431/264; 431/153; 431/254; 431/255; 431/256; 431/263; 431/345; 431/346

(58) Field of Classification Search ..... 431/153, 431/254, 255, 256, 263, 264, 345, 346
See application file for complete search history.

(56) References Cited

U.S. PATENT DOCUMENTS

| | | | | | |
|---|---|---|---|---|---|
| 1,808,968 | A | * | 6/1931 | Plumley | 239/416.2 |
| 2,195,944 | A | * | 4/1940 | Stream | 228/53 |
| 2,484,891 | A | * | 10/1949 | Jones | 148/194 |
| 2,638,972 | A | * | 5/1953 | Sparks | 431/254 |
| 2,888,066 | A | * | 5/1959 | Wilson | 431/255 |
| 3,155,140 | A | * | 11/1964 | Wilson | 431/153 |
| 3,220,459 | A | * | 11/1965 | Wilson | 431/255 |
| 3,255,803 | A | | 6/1966 | Hach, Jr. et al. | |
| 3,280,881 | A | * | 10/1966 | Hach, Jr. et al. | 431/255 |
| 3,431,058 | A | * | 3/1969 | Hufferd | 431/264 |
| 3,694,134 | A | * | 9/1972 | Ross | 431/255 |
| 4,231,734 | A | * | 11/1980 | Burns | 431/274 |
| 4,455,176 | A | * | 6/1984 | Fuhrhop | 148/194 |
| 4,948,942 | A | * | 8/1990 | Hiibel | 219/132 |
| 5,120,026 | A | * | 6/1992 | Bissonnette | 266/48 |
| 5,390,855 | A | | 2/1995 | Mims et al. | |

(Continued)

FOREIGN PATENT DOCUMENTS

DE 3516511 A1 11/1986

(Continued)

OTHER PUBLICATIONS

International Search Report- PCT/US2009/039779 mailed on Nov. 26, 2009.

(Continued)

*Primary Examiner* — Kenneth Rinehart
*Assistant Examiner* — Jorge Pereiro
(74) *Attorney, Agent, or Firm* — Brinks Hofer Gilson & Lione

(57) ABSTRACT

A gas torch is provided that includes an auto-ignition system disposed within the gas torch, a preheat oxygen conduit array extending through the gas torch, a fuel gas conduit array extending through the gas torch, and a cutting oxygen conduit array extending through the gas torch. At least one safety device is disposed within the gas torch, such as check valves and flashback arrestors, by way of example. The gas torch also includes a cutting oxygen trigger and an ignition trigger operable to start preheat gas flow and to ignite the gas torch. The ignition trigger is configured for automatic disengagement of the auto-ignition system when the ignition trigger is released.

17 Claims, 44 Drawing Sheets

U.S. PATENT DOCUMENTS

| | | | | |
|---|---|---|---|---|
| 5,407,348 | A * | 4/1995 | Mims et al. | 431/346 |
| 5,470,227 | A * | 11/1995 | Mims et al. | 431/255 |
| 5,540,585 | A * | 7/1996 | Coulcher et al. | 431/264 |
| 5,571,427 | A * | 11/1996 | Dimock et al. | 219/75 |
| 5,597,497 | A * | 1/1997 | Dean et al. | 219/121.48 |
| 5,792,281 | A * | 8/1998 | Diehl | 148/205 |
| 6,634,571 | B2 * | 10/2003 | Shimazu | 239/381 |
| 6,726,471 | B2 * | 4/2004 | Parkin et al. | 431/346 |
| 6,910,881 | B2 * | 6/2005 | Parkin et al. | 431/346 |
| 6,979,422 | B2 * | 12/2005 | Parkin et al. | 266/48 |
| 7,300,277 | B2 * | 11/2007 | Foos et al. | 431/345 |
| 2003/0075618 | A1 * | 4/2003 | Shimazu | 239/381 |
| 2003/0096207 | A1 * | 5/2003 | Parkin et al. | 431/346 |
| 2004/0086819 | A1 * | 5/2004 | Wakeman | 431/346 |
| 2004/0161719 | A1 * | 8/2004 | Parkin et al. | 431/346 |
| 2004/0175664 | A1 * | 9/2004 | Parkin et al. | 431/346 |
| 2008/0061482 | A1 | 3/2008 | Faust et al. | |

FOREIGN PATENT DOCUMENTS

| | | |
|---|---|---|
| EP | 0212190 | 3/1987 |
| EP | 0550051 | 12/1998 |

OTHER PUBLICATIONS

Koike Torch Brochure.
Victor Equipment Quantum 2009 internal presentation.

* cited by examiner

ADVANCED GAS TORCH

FIELD

The present disclosure relates generally to oxy-fuel torches and more particularly to oxy-fuel torches having built-in electrical ignition systems, or auto-ignition systems.

BACKGROUND

The statements in this section merely provide background information related to the present disclosure and may not constitute prior art.

Oxy-fuel torches, or gas torches, generally employ oxygen and a fuel gas, such as acetylene or propane, by way of example, to cut or heat a workpiece. More specifically, preheat oxygen and the fuel gas are mixed and ignited to provide heat to the workpiece, and then additional oxygen, commonly referred to as cutting oxygen, is added to react with the heated workpiece. This reaction of the cutting oxygen with the heated workpiece initiates sufficient heat and momentum of the gases to initiate a cutting process.

To ignite the preheat oxygen and fuel gas, a "striker" is often used, which is a device that creates a spark for ignition. The operator typically adjusts the flow of preheat oxygen and fuel gas for ignition, and then while holding the torch in one hand uses the other hand to operate the striker at another end of the torch. Once the gases are ignited, the operator then stores the striker and further adjusts the flow of gases in order to optimize the flame and initiate the cutting process. Therefore, starting a gas torch requires the use of two hands and is often cumbersome and time consuming for the operator. Additionally, operators often use other ignition devices that may not be safe, such as a cigarette lighter or even a cigarette that extends from the mouth of the operator.

There exist some auto-ignition gas cutting torches in the field, which typically employ a piezoelectric igniter and spark source near the handle of the torch. In this way, a separate striker or ignition source is not required, and an operator can more easily ignite the torch. However, such gas cutting torches include controls that are often difficult to manipulate, are tiring to use over time, and lack certain safety features.

During operation, undesirable gas mixtures and flames can travel back through the torch and the gas hoses and present safety concerns. One such scenario is often referred to as "flashback," which occurs when flames from the cutting torch travel back into the gas hoses. Another scenario is referred to as "backfire," in which the combustible mixture of gases flows back into the torch and causes a sudden "popping" noise/effect in of the torch. Yet another scenario is "sustained backfire," where the combustible mixture of gases is constantly being fed back into the torch and a constant "popping" occurs, and thus the torch does not operate properly. When inadvertent flashback or combustion occurs within or near the gas cutting torch, operators often drop the gas cutting torch without shutting off the gas supplies in an immediate reaction to escape any perceived harm. Additionally, operators often drop the gas cutting torch in certain circumstances when their attention is needed, such as to attending to a coworker that is in need of help, or when breaking a fall, by way of example. When the gas cutting torch is dropped without properly shutting off the gas supplies, dangerous situations may occur, such as explosions, fires, in addition to causing damage to the torch itself. Therefore, some conventional gas cutting torches can be dangerous if not operated properly or if not designed properly.

With the inherent difficulties in starting and operating gas cutting torches and the attendant dangers of operation, improved ergonomic and human factor designs and safety features are continuously desired in the field of gas cutting torches. Moreover, productivity enhancements and ways in which to reduce the amount of gas that is wasted during operation are also desirable.

SUMMARY

In one form, the present disclosure provides a gas torch comprising an auto-ignition system disposed within the gas torch, a preheat oxygen conduit array extending through the gas torch, a fuel gas conduit array extending through the gas torch, and a cutting oxygen conduit array extending through the gas torch. At least one safety device is disposed within the gas torch, along with a cutting oxygen trigger, and an ignition trigger operable to start preheat gas flow and to ignite the gas torch. The ignition trigger is configured for automatic disengagement of the auto-ignition system when the ignition trigger is released.

In another form of the present disclosure, a gas torch is provided that comprises an auto-ignition system disposed within the gas torch, a preheat oxygen conduit array extending through the gas torch, a fuel gas conduit array extending through the gas torch, and a cutting oxygen conduit array extending through the gas torch. A plurality of check valves are disposed within the gas torch, along with a plurality of flashback arrestors, which act as safety devices. The gas torch also includes a cutting oxygen trigger and an ignition trigger operable to start preheat gas flow and to ignite the gas torch. The ignition trigger is configured for automatic disengagement of the auto-ignition system when the ignition trigger is released.

In still another form, a gas torch is provided that comprises an auto-ignition system disposed within the gas torch, at least one safety device disposed within the gas torch, a cutting oxygen trigger, and an ignition trigger operable to start preheat gas flow and to ignite the gas torch, the ignition trigger configured for automatic disengagement of the auto-ignition system when the ignition trigger is released.

Further areas of applicability of the present disclosure will become apparent from the detailed description provided hereinafter. It should be understood that the detailed description and specific examples, while indicating the embodiments of the disclosure, are intended for purposes of illustration only and are not intended to limit the scope of the disclosure.

BRIEF DESCRIPTION OF THE DRAWINGS

The present invention will become more fully understood from the detailed description and the accompanying drawings, wherein.

Corresponding reference numerals indicate corresponding parts throughout the several views of the drawings.

DETAILED DESCRIPTION

The following description of the embodiments is merely exemplary in nature and is in no way intended to limit the disclosure, its application, or uses.

Figure 1:
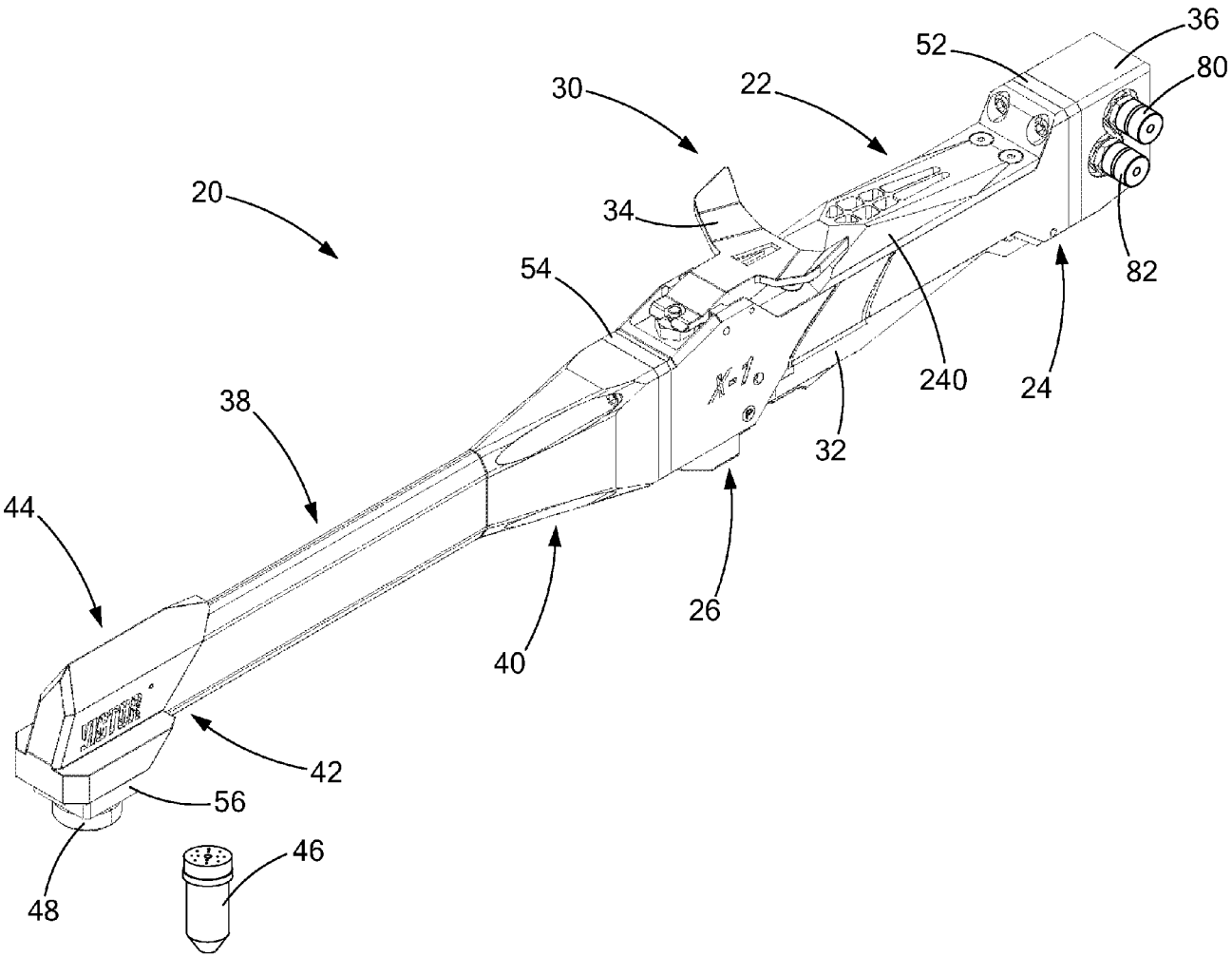
FIG. 1 is a perspective view of one form of the gas cutting torch constructed in accordance with the principles of the present disclosure.
Figure 2:
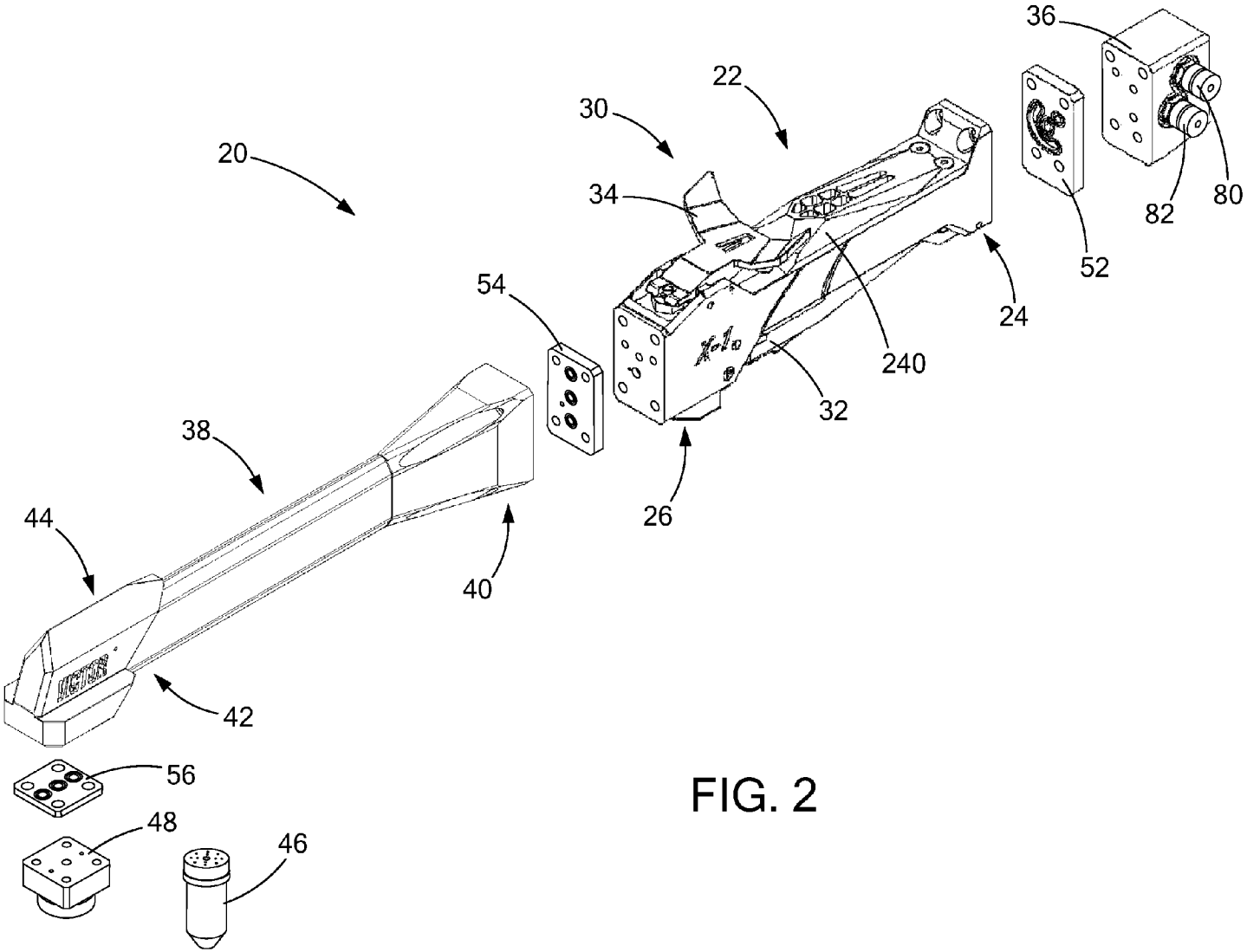
FIG. 2 is an exploded perspective view of the gas cutting torch in accordance with the principles of the present disclosure.
Figure 3:
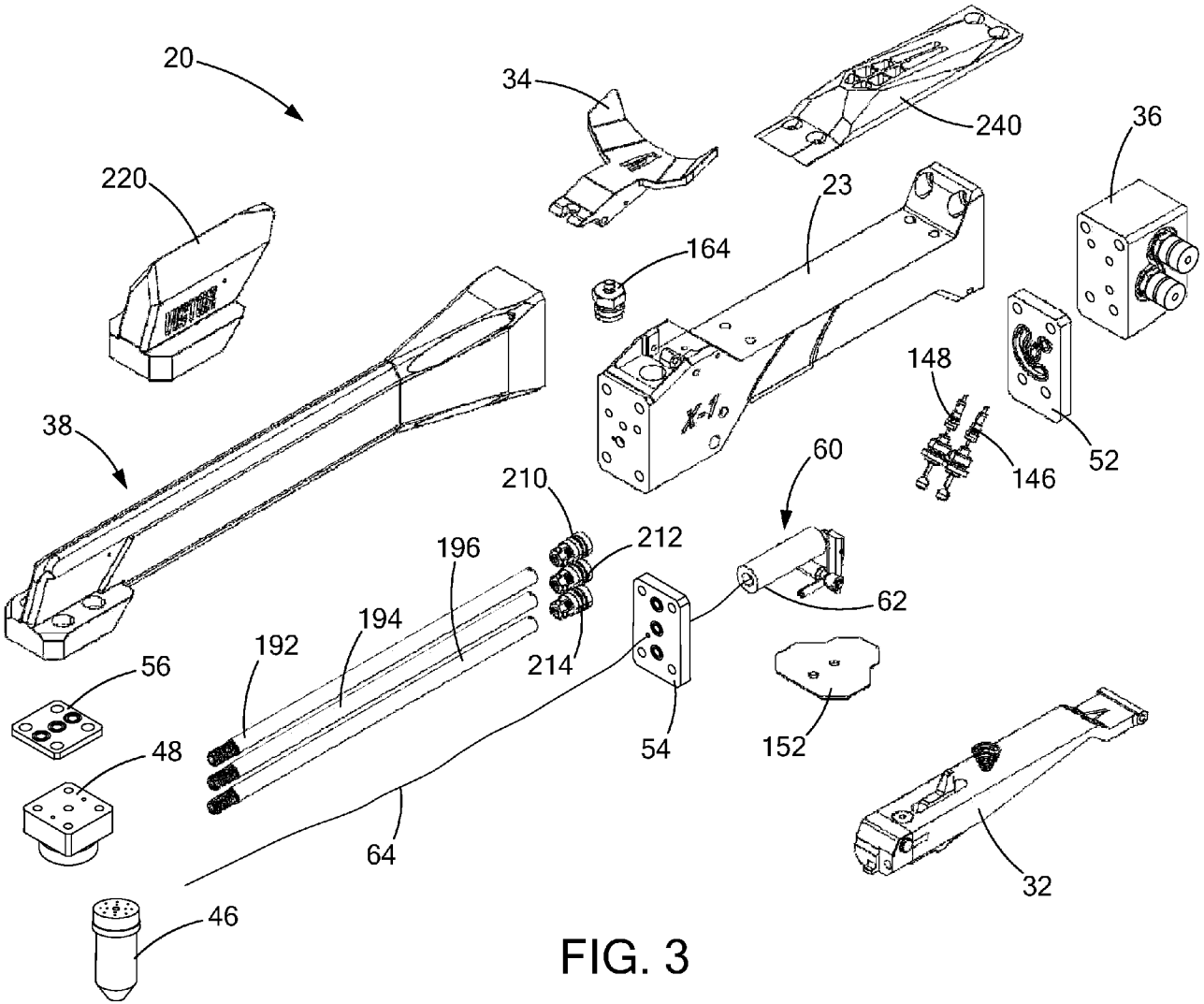
FIG. 3 is another exploded view of the gas cutting torch in accordance with the principles of the present disclosure.

Referring to FIGS. 1-3, a gas cutting torch in accordance with the teachings of the present disclosure is illustrated and generally indicated by reference numeral 20. Although the term "cutting" is used thoughout, it should be understood that the present disclosure applies generally to gas torches, such as those that heat and/or cut. Accordingly, the term "cutting" should not be construed to limit the scope of the present disclosure. The gas cutting torch 20 comprises a handle portion 22 defining a proximal end portion 24 and a distal end portion 26, and a trigger system 30 disposed along the handle portion 22 as shown. The trigger system 30 comprises an ignition trigger 32 and a cutting oxygen trigger 34. A flow control unit 36 is disposed at the proximal end portion 24 of the handle 22. A tube section 38 is disposed at the distal end portion 26 of the handle portion 22, and the tube section similarly defines a proximal end portion 40 and a distal end portion 42. A head portion 44 is disposed proximate the distal end portion 42 of tube section 38, and a cutting tip 46 is secured to the head portion 44. More specifically, in one form of the present disclosure, a tip seat 48 is secured to the head portion 44, and the cutting tip 46 is secured to the tip seat 48 by way of a locking nut 50. It should be understood that other forms of a locking nut 50 that do not require a tool, such as a quick-disconnect device, may be employed while remaining within the scope of the present disclosure.

As further shown, a first plate seal 52 is disposed between the handle portion 22 and the flow control unit 36, a second plate seal 54 is disposed between the handle portion 22 and the tube section 38, and a third plate seal 56 is disposed between the head portion 44 and the cutting tip 46, and more specifically, the tip seat 48. The plate seals 52, 54, and 56 generally function to direct or channel a flow of oxygen and fuel gas, as described in greater detail below, and also to seal the interfaces between the various components of the gas cutting torch 20.

Additionally, with reference to FIG. 3, an ignition system 60 is disposed within the gas cutting torch 20, and in one form comprises a piezoelectric igniter 62 in communication with the ignition trigger 32 and an ignition wire 64 that extends from the piezoelectric igniter 62 to the cutting tip 46. Operation of the ignition system 60 is described in greater detail below.

Figure 4:
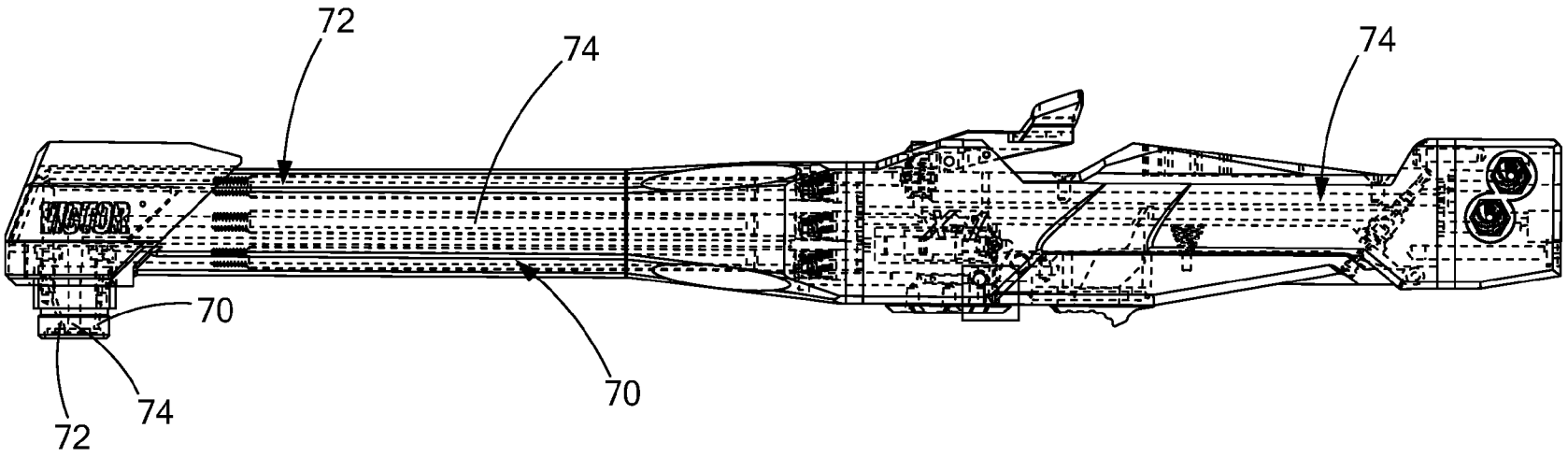
FIG. 4 is a side hidden line view illustrating various conduit arrays constructed in accordance with the principles of the present disclosure.
Figure 5:
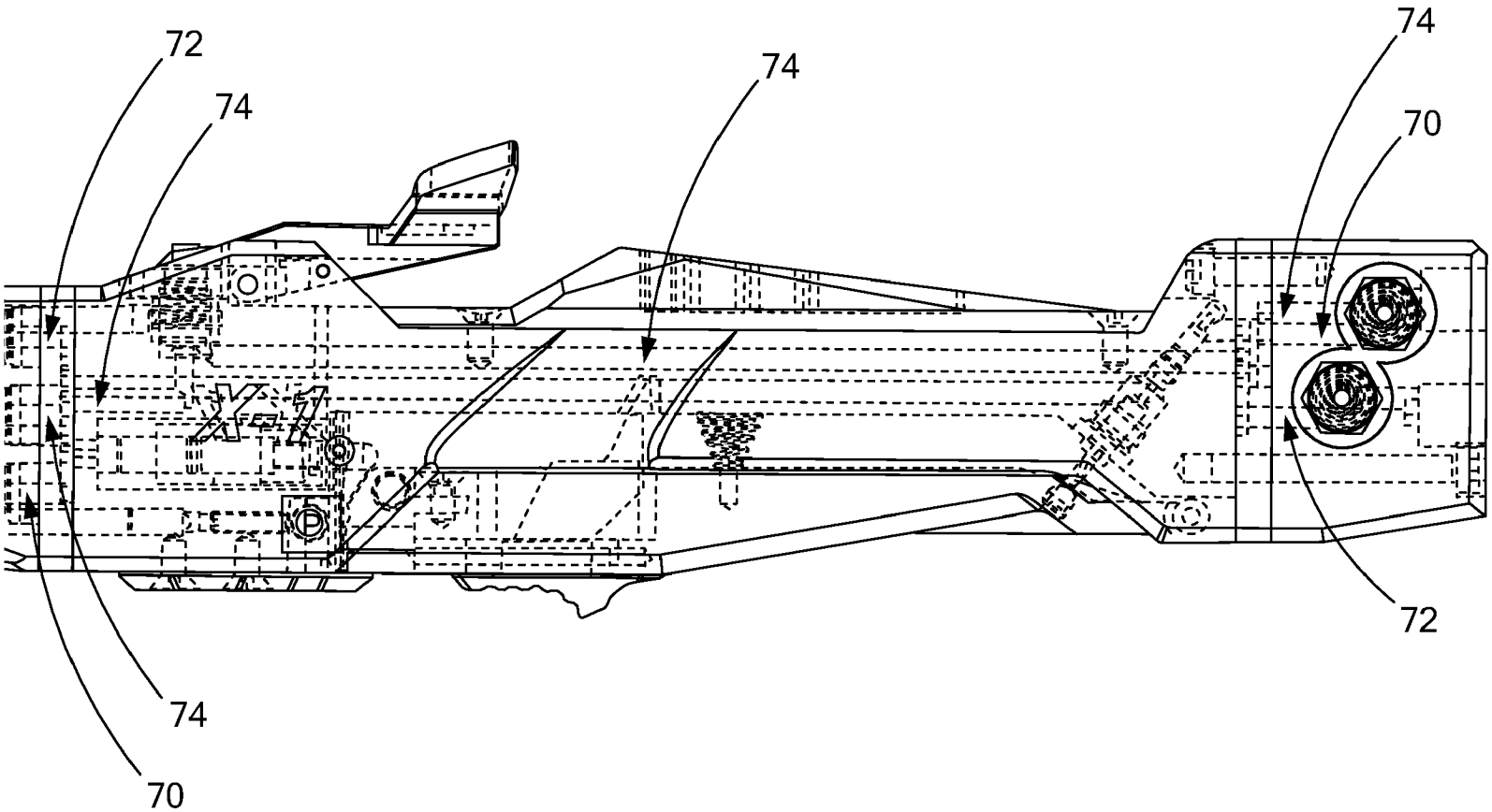
FIG. 5 is an enlarged side hidden line view illustrating the conduit arrays near the handle portion of the gas cutting torch in accordance with the principles of the present disclosure.
Figure 6:
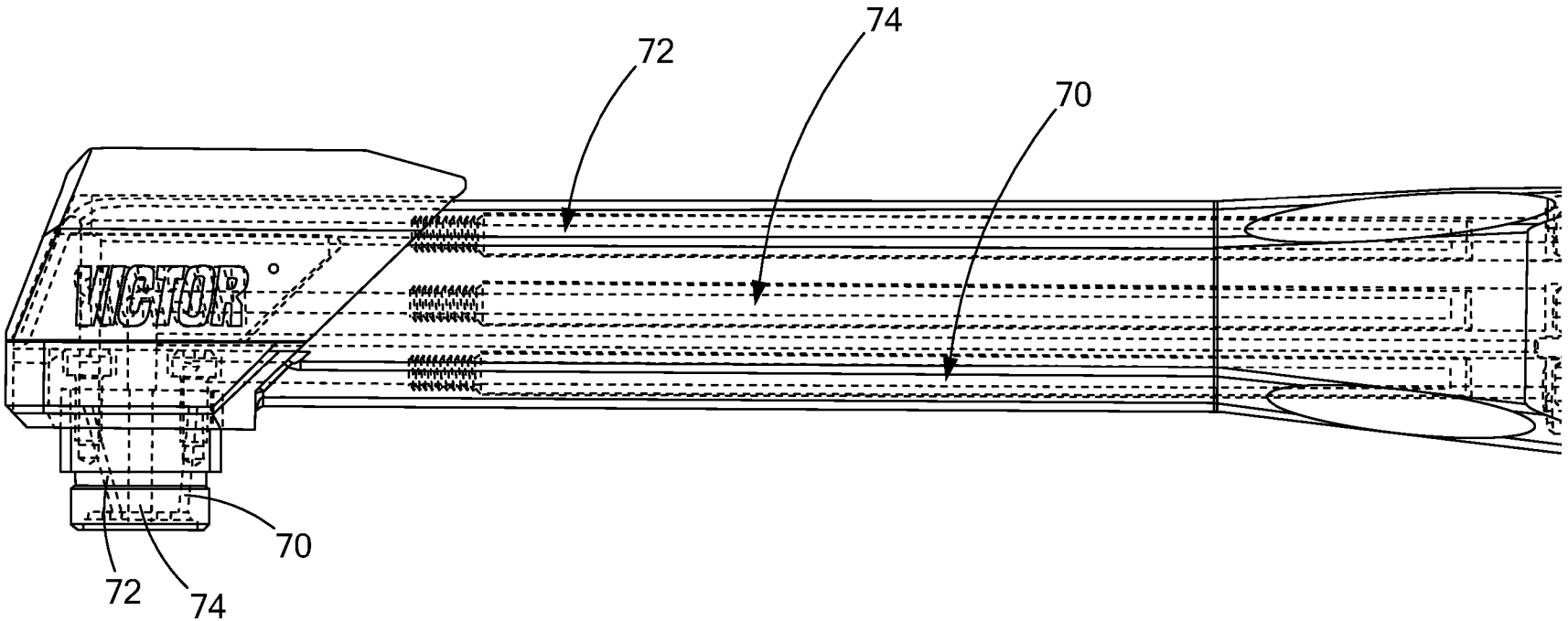
FIG. 6 is an enlarged side hidden line view illustrating the conduit arrays near the tube section of the gas cutting torch in accordance with the principles of the present disclosure.
Figure 7:
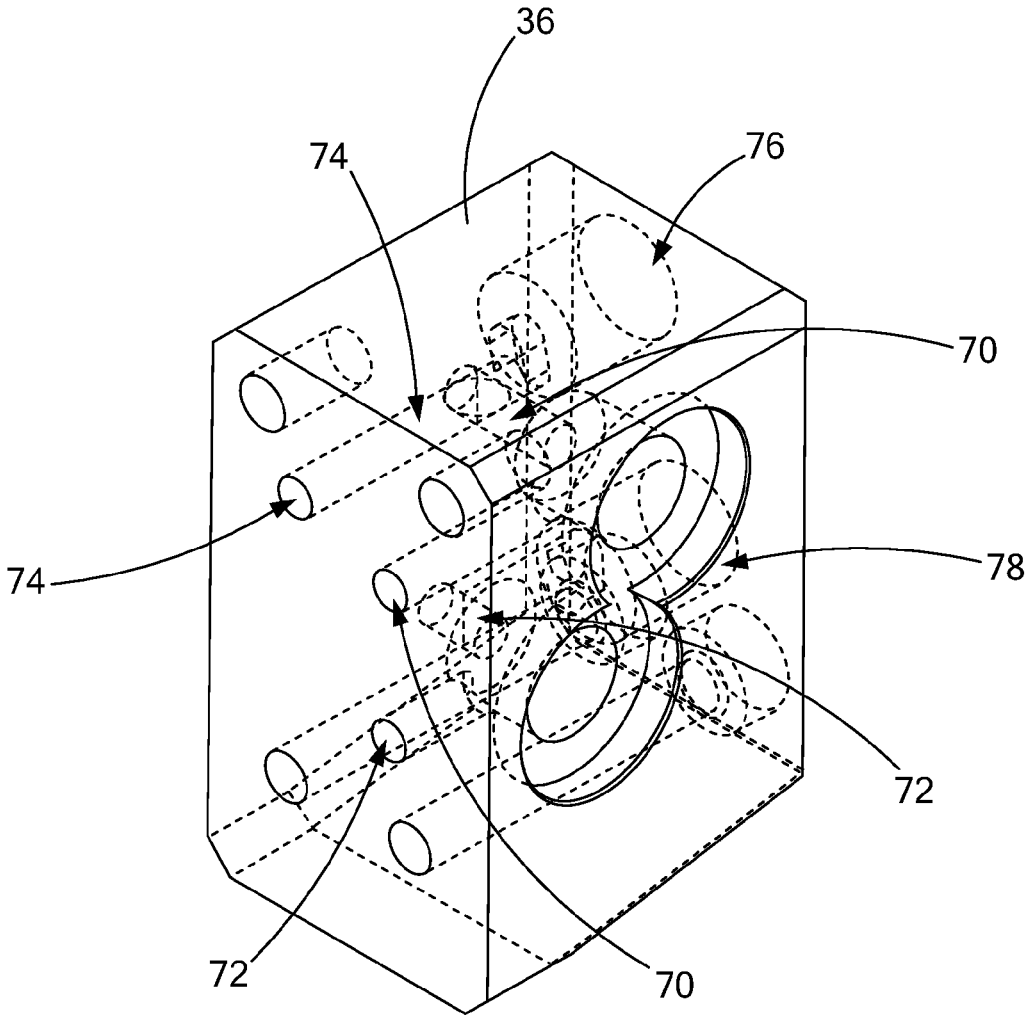
FIG. 7 is a perspective hidden line view illustrated the conduit arrays through a flow control unit constructed in accordance with the principles of the present disclosure.
Figure 8:
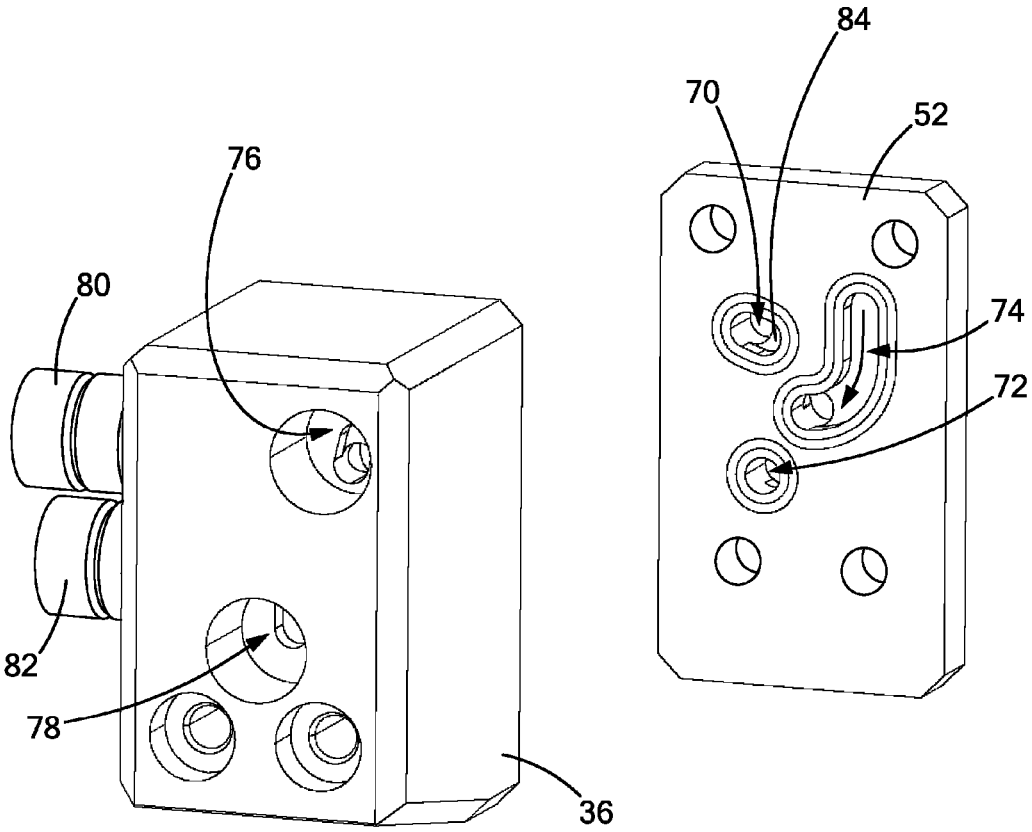
FIG. 8 is a rear perspective exploded view of the flow control unit and a first plate seal constructed in accordance with the principles of the present disclosure.

Referring now to FIGS. 4-6, the gas cutting torch 20 comprises a plurality of internal gas passageways for the flow of preheat oxygen, fuel gas, and cutting oxygen. More specifically, a preheat oxygen conduit array 70 extends from the flow control unit 36, through the first plate seal 52, through the handle section 22, through the second plate seal 54, through the tube section 38, through the third plate seal 56, through the tip seat 48, and to the cutting tip 46. A fuel gas conduit array 72 extends from the flow control unit 36, through the first plate seal 52, through the handle section 22, through the second plate seal 54, through the tube section 38, through the third plate seal 56, through the tip seat 48, and to the cutting tip 46. A cutting oxygen conduit array 74 similarly extends from the flow control unit 36, through the first plate seal 52, through the handle section 22, through the second plate seal 54, through the tube section 38, through the third plate seal 56, through the tip seat 48, and to the cutting tip 46.

Figure 9:
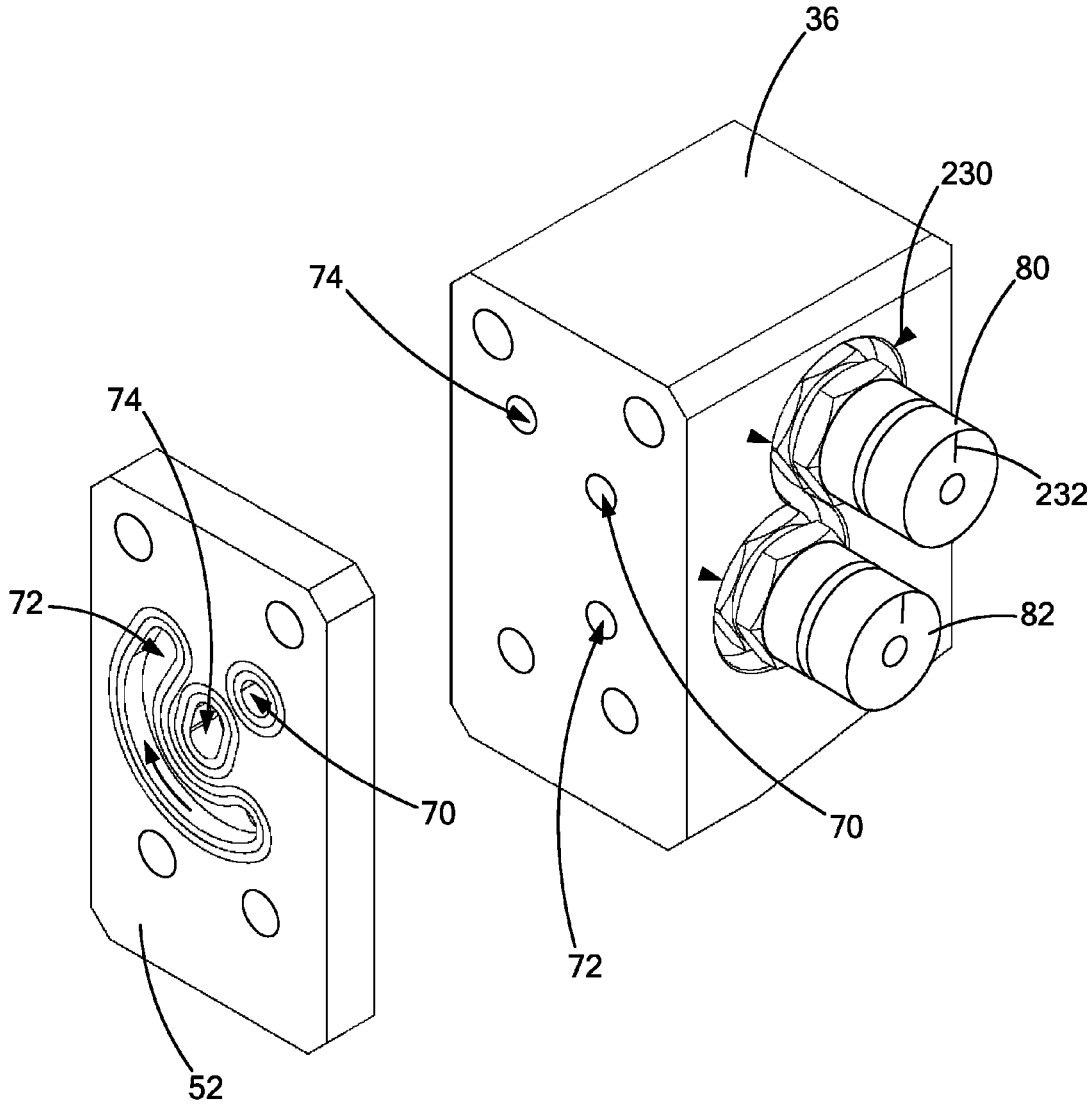
FIG. 9 is a front perspective exploded view of the flow control unit and the first plate seal in accordance with the principles of the present disclosure.
Figure 10A:
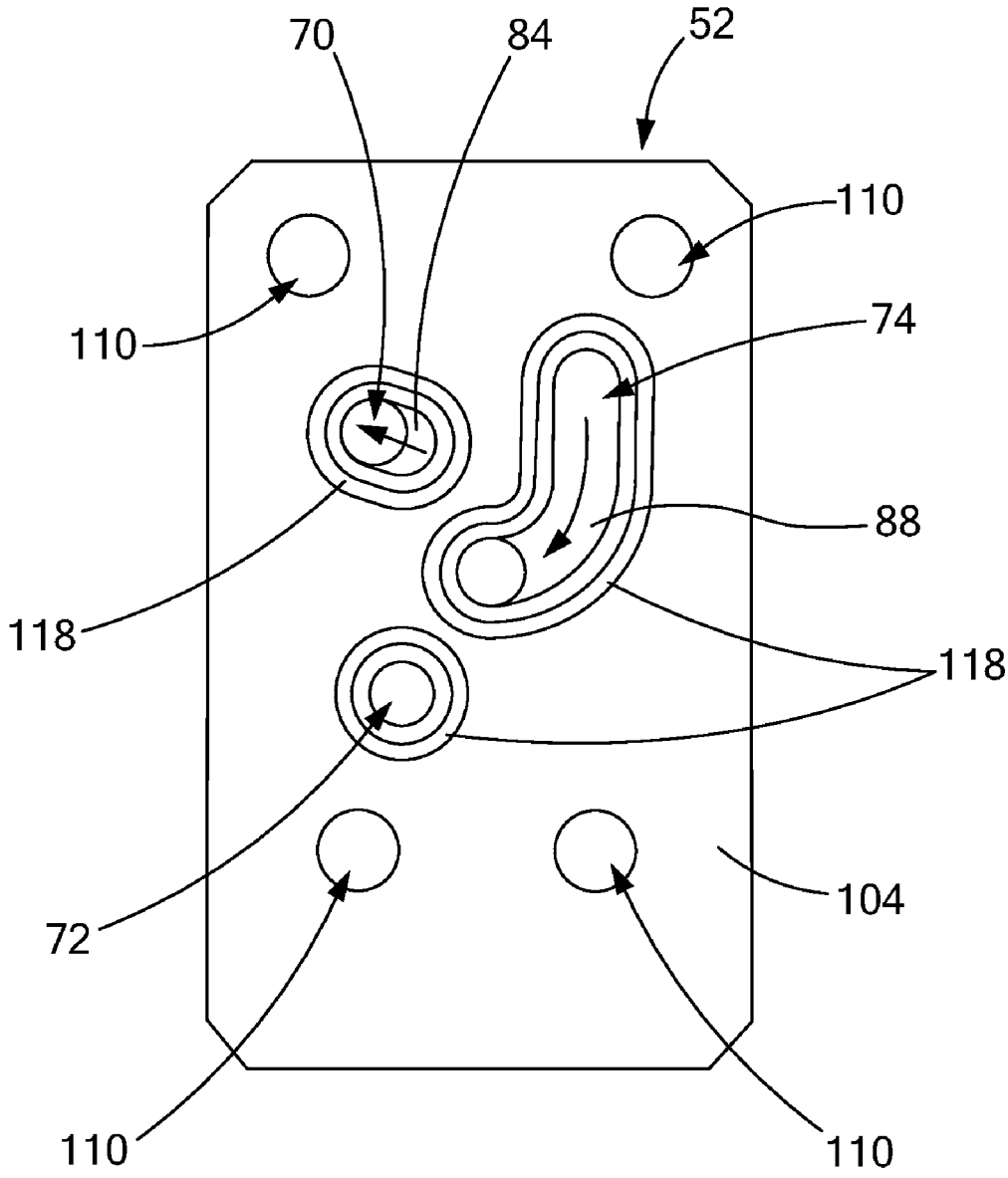
FIG. 10*a* is a front view of the first plate seal and its gas channels constructed in accordance with the principles of the present disclosure.
Figure 10B:
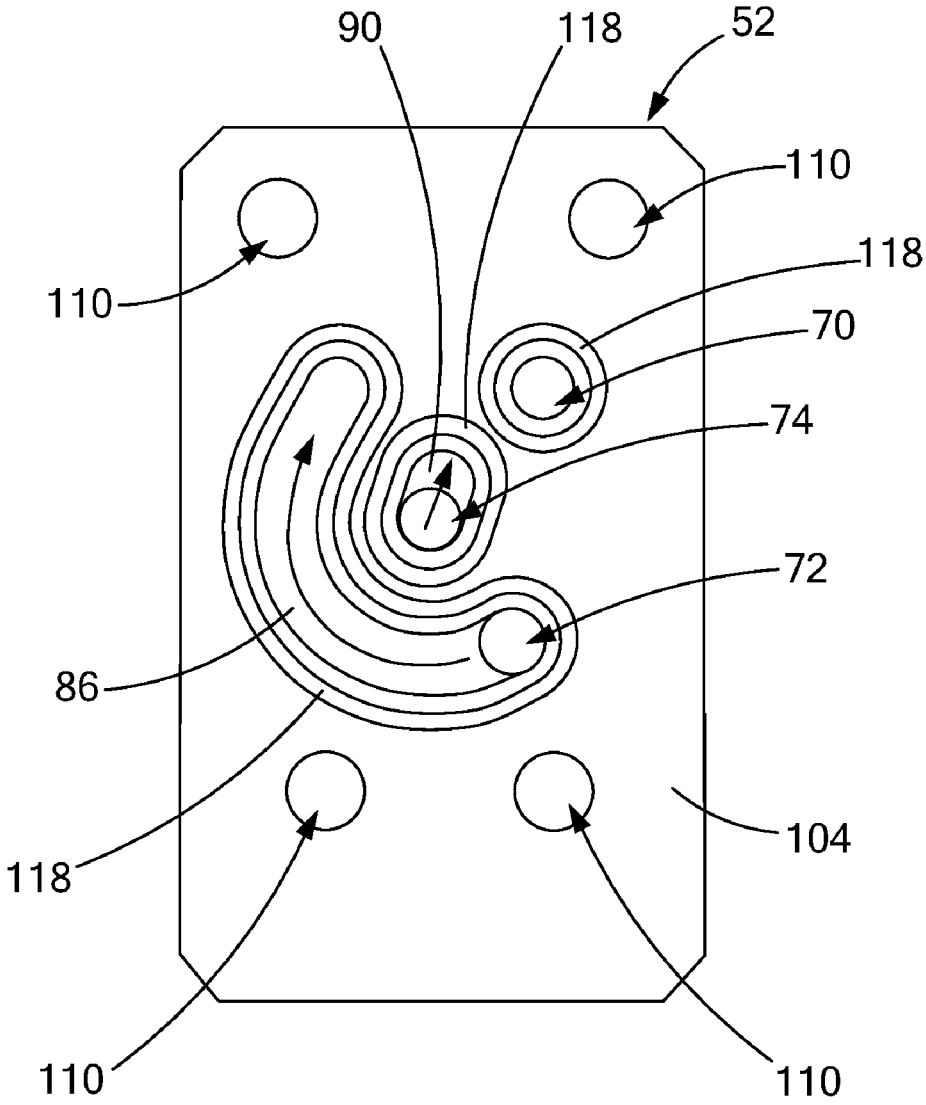
FIG. 10*b* is a rear view of the first plate seal and its gas channels constructed in accordance with the principles of the present disclosure.
Figure 11:
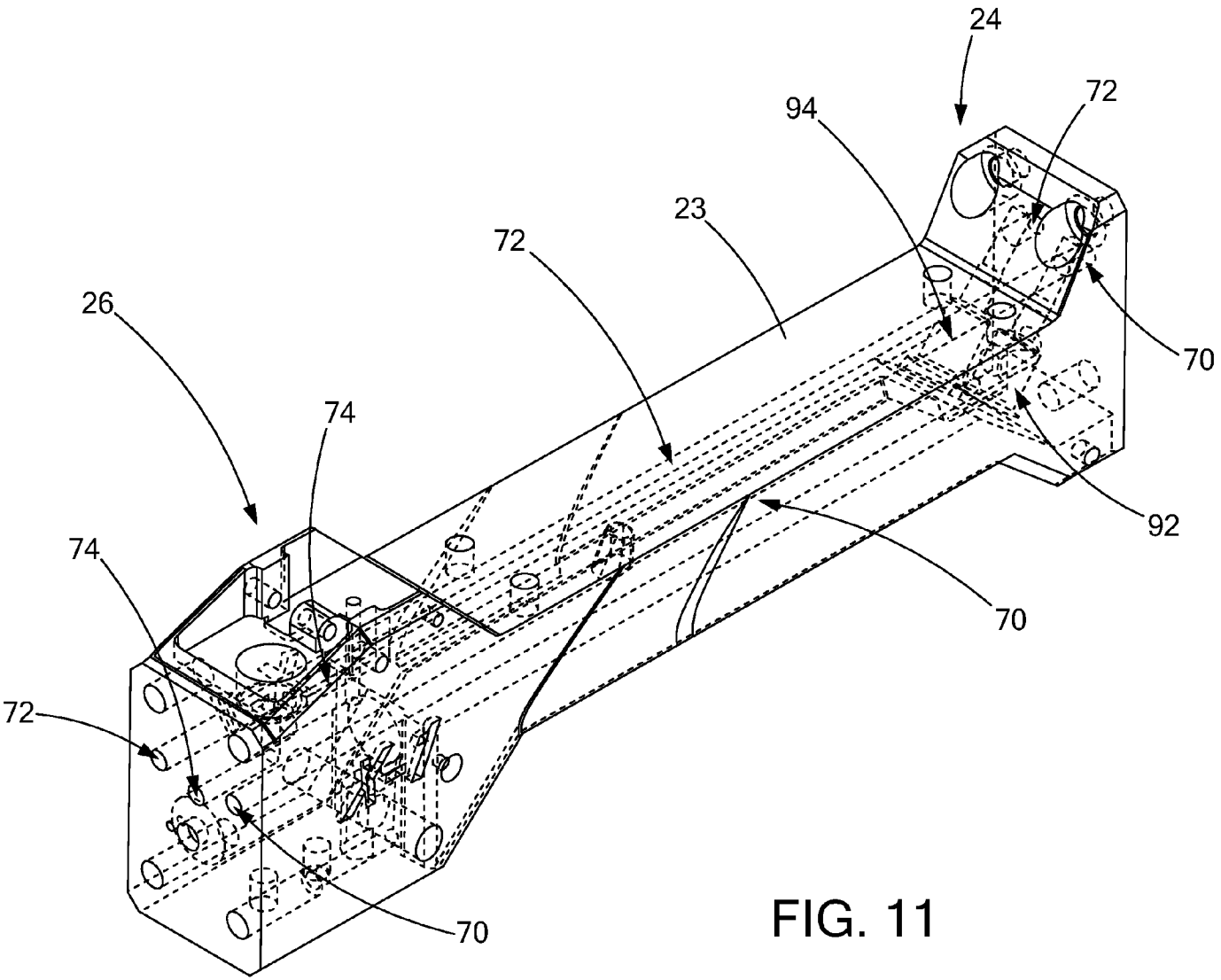
FIG. 11 is a perspective hidden line view of a handle body and conduit arrays constructed in accordance with the principles of the present disclosure.
Figure 12:
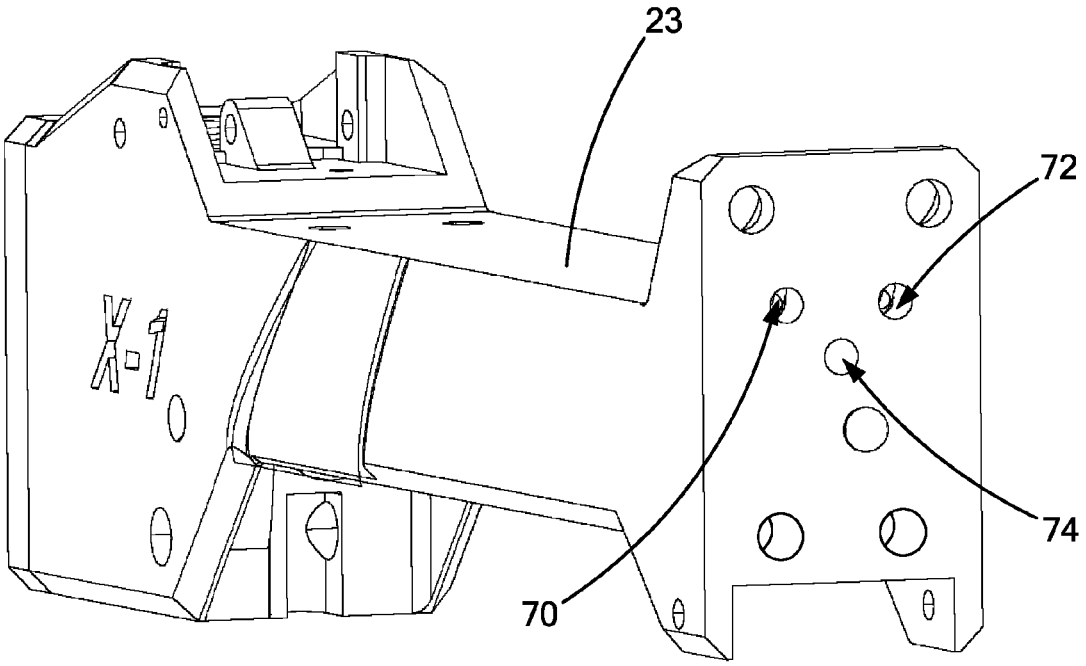
FIG. 12 is a perspective view of a proximal end portion of the handle body and conduit arrays in accordance with the principles of the present disclosure.

The conduit arrays 70, 72, and 74 are now described in greater detail as they pass through various components of the gas cutting torch 20. Referring first to FIGS. 7-10*b*, the conduit arrays through flow control unit 36 and the first plate seal 52 are shown. The flow control unit 36 generally includes an oxygen inlet port 76 and a fuel gas inlet port 78. Oxygen flow is split within the flow control unit 36, and the preheat oxygen conduit array 70 extends from the oxygen inlet port 76 through a preheat oxygen metering device 80 (shown in FIGS. 8 and 9 and described in greater detail below), and out the flow control unit 36 as shown. The preheat oxygen conduit array 70 then extends to the first plate seal 52 and is follows a channel 84 from the front side of the plate seal 52 to the back side of the plate seal 52 as best shown in FIGS. 10*a* and 10*b*.

The fuel gas conduit array 72 extends from the fuel gas inlet port 78, through a preheat fuel gas metering device 82 (shown in FIGS. 8 and 9 and described in greater detail below), and out the flow control unit 36 as shown. The fuel gas conduit array 72 then extends directly through the first plate seal 52 and follows a channel 86 along the back side of the plate seal 52 as best shown in FIG. 10*b*.

The cutting oxygen conduit array 74 extends from the oxygen inlet port 76, through the flow control unit 36, and out the flow control unit 36 as shown. The cutting oxygen conduit array 74 then extends to the first plate seal 52 and follows a channel 88 from the front side of the plate seal 52 to the back side of the plate seal 52 as shown in FIG. 10*a*. Upon entering the back side of the plate seal 52, the cutting oxygen conduit array 74 follows another channel 90 as shown in FIG. 10*b*.

Figure 13:
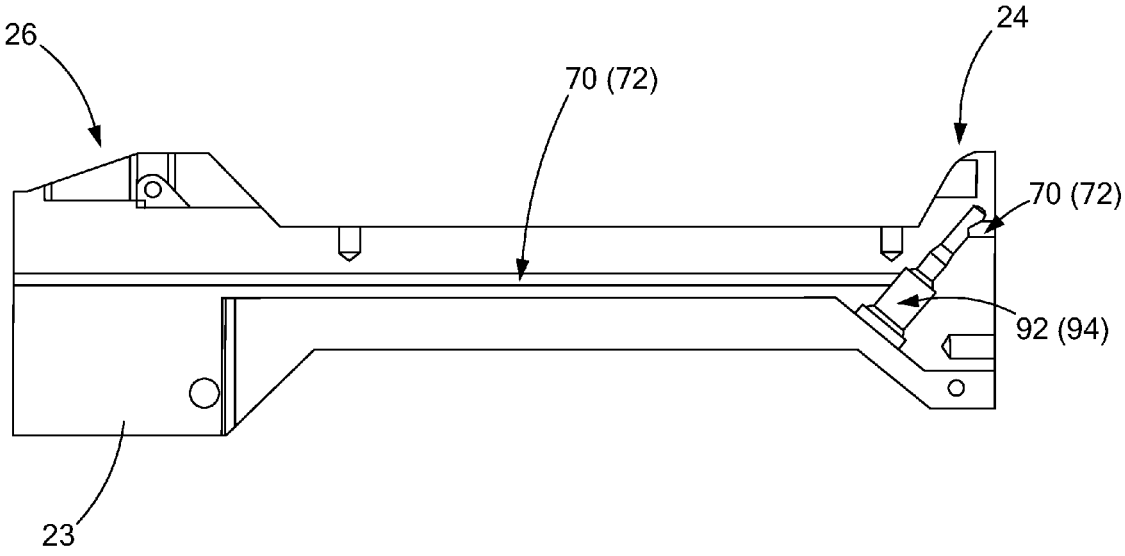
FIG. 13 is a cross-sectional view illustrating portions of a preheat gas conduit array and a fuel gas conduit array constructed in accordance with the principles of the present disclosure.
Figure 14:
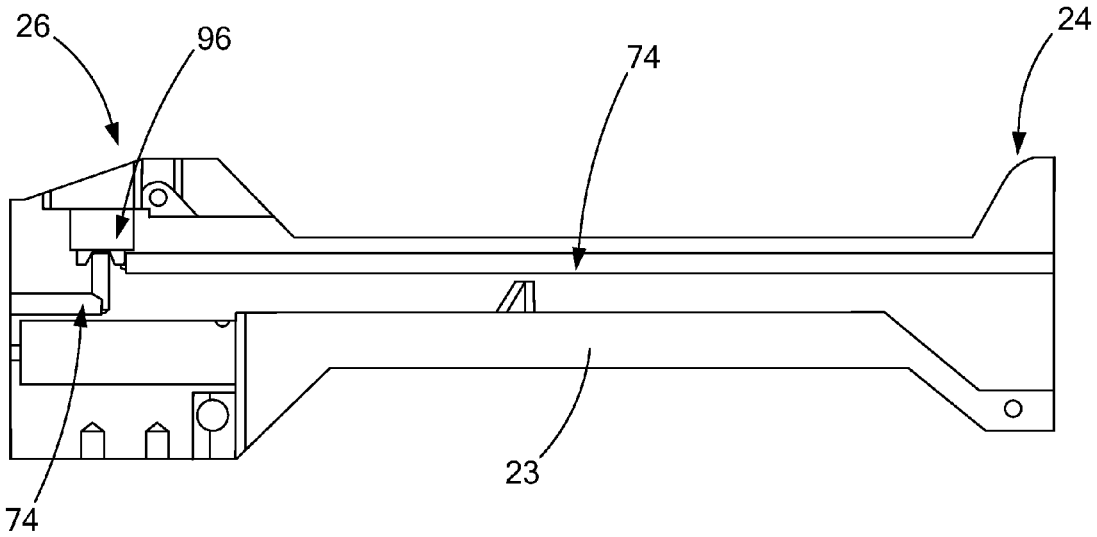
FIG. 14 is a cross-sectional view illustrating a portion of a cutting oxygen conduit array constructed in accordance with the principles of the present disclosure.

Moving now to the handle section 22, and with reference to FIGS. 10*b* and 11-14, the handle section 22 comprises a handle body 23, which is illustrated without other components of the handle section 22 for purposes of clarity. The preheat oxygen conduit array 70 extends from the back of the first plate seal 52 to the proximal end portion 24 of the handle body 23, through a first gas control device cavity 92 (shown in FIGS. 11 and 13) and to the distal end portion 26. Similarly, the fuel gas conduit array 72 extends from the channel 86 of the first plate seal 52 to the proximal end portion 24 of the handle body 23, through a second gas control device cavity 94, and to the distal end portion 26. (It should be noted that FIG. 13 is a cross-sectional view that represents portions of both the preheat oxygen conduit array 70 and the fuel gas conduit array 72, since the cross-sectional views of these arrays are symmetrical). The cutting oxygen conduit array 74 extends from the channel 90 of the first plate seal 52 to the proximal end portion 24, through the handle body 23 as shown, through a third gas control device cavity 96, and to the distal end portion 26.

Figure 15:
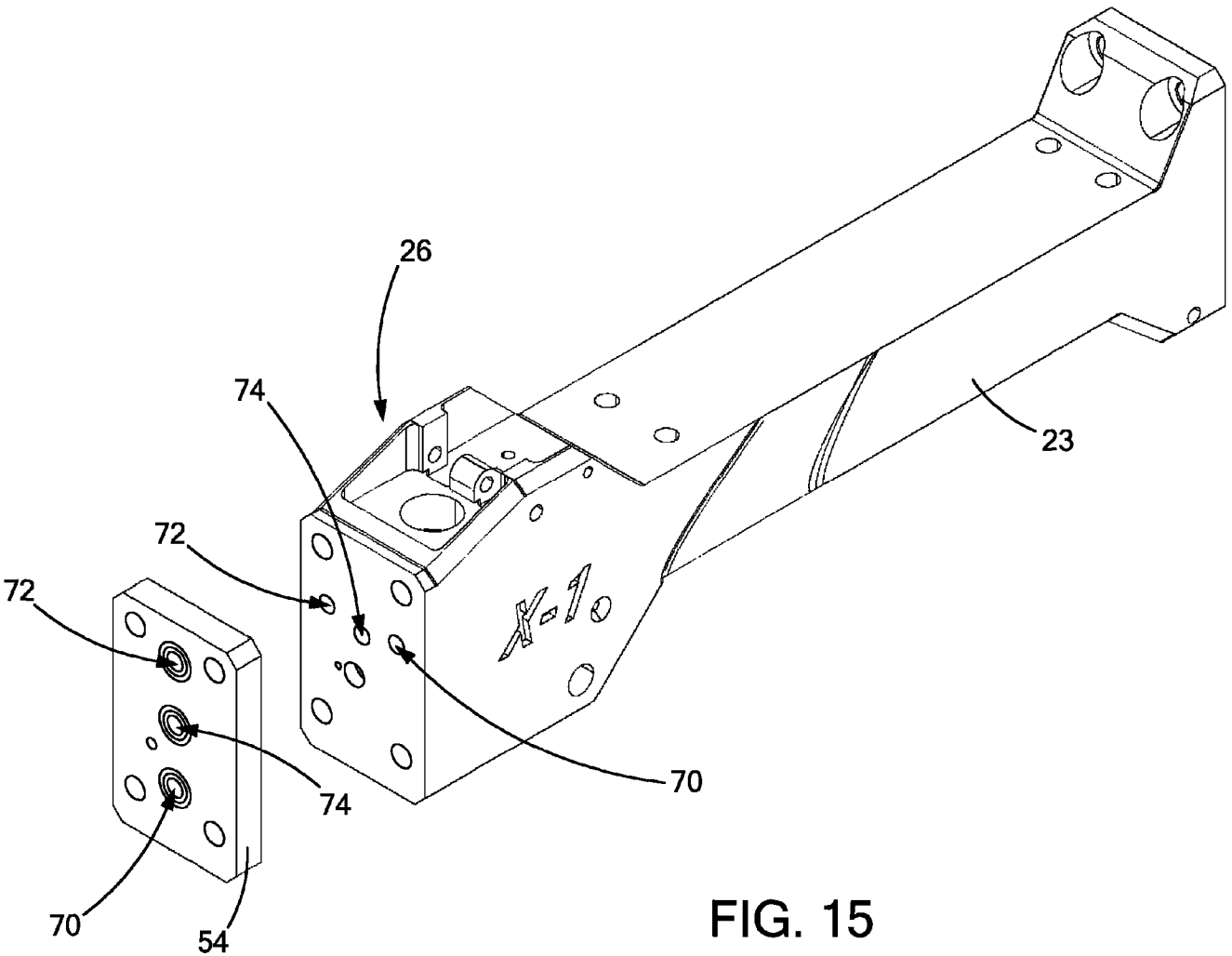
FIG. 15 is an exploded perspective view illustrating the handle body and a second plate seal constructed in accordance with the principles of the present disclosure.
Figure 16A:
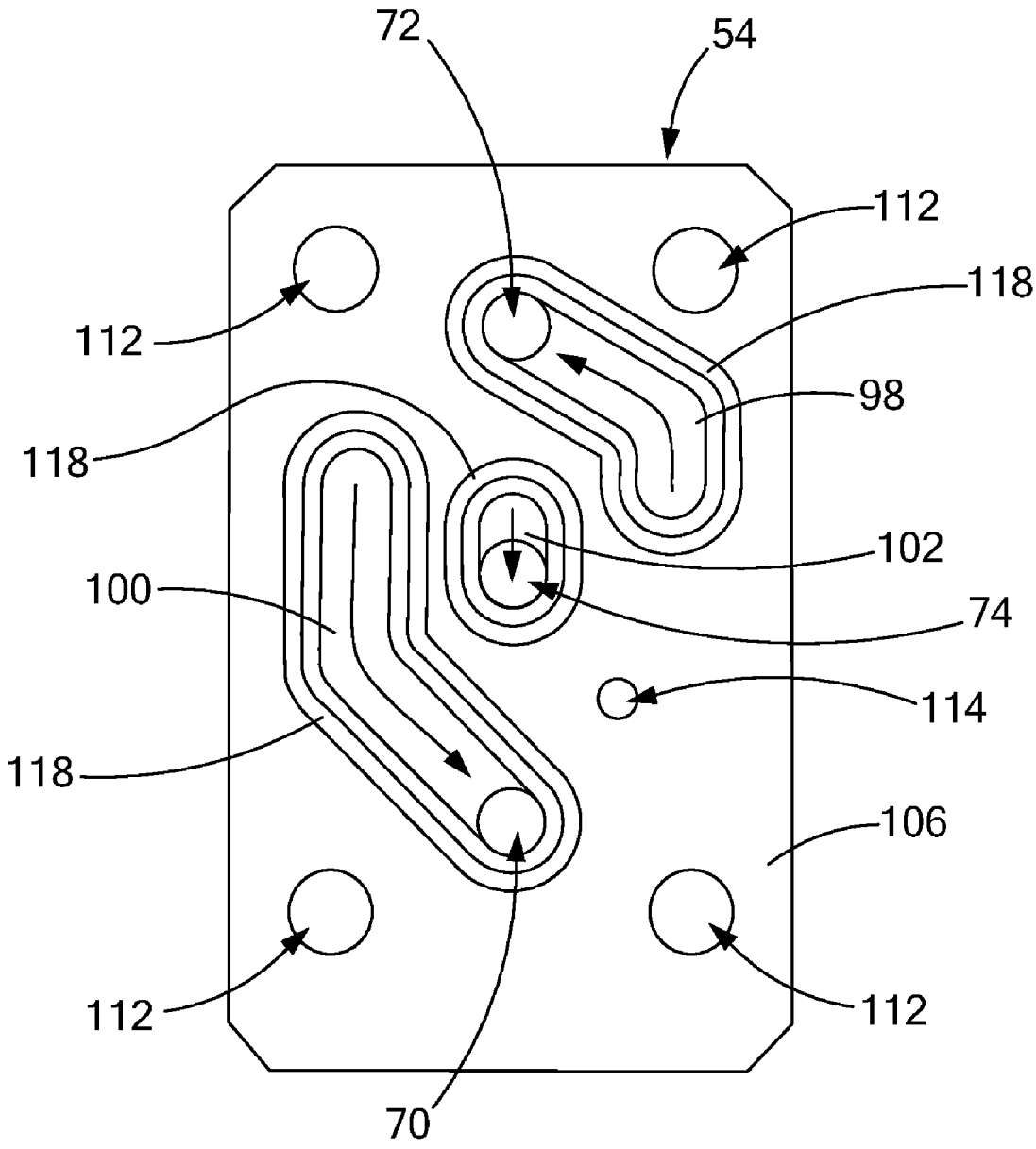
FIG. 16*a* is a front view of the second plate seal and its gas channels constructed in accordance with the principles of the present disclosure.
Figure 16B:
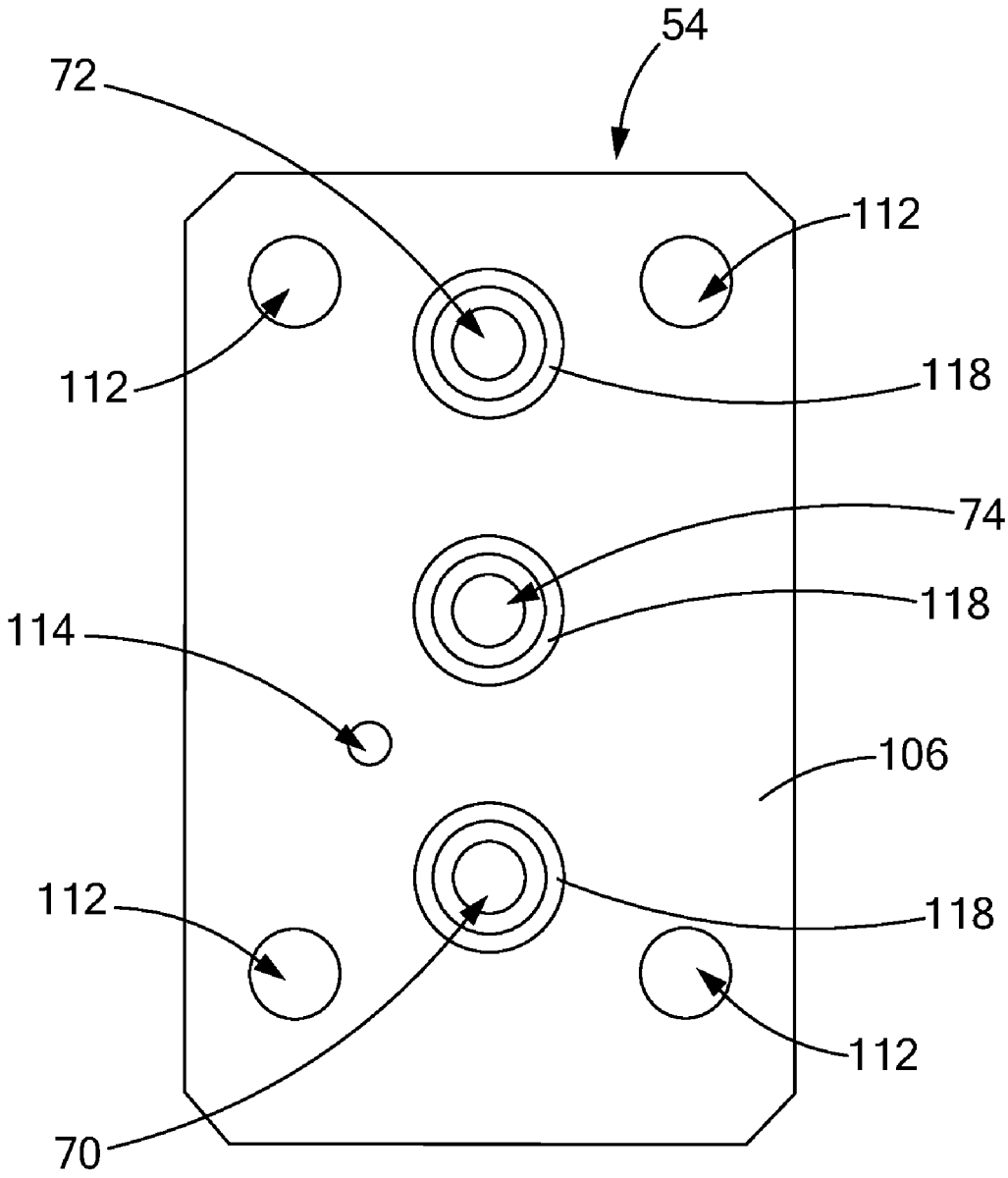
FIG. 16*b* is a rear view of the second plate seal constructed in accordance with the principles of the present disclosure.

Referring now to FIGS. 15-16*b*, the conduit arrays as they pass through the distal end portion 26 of the handle body 23 and the second plate seal 54 are now illustrated and described in greater detail. The preheat oxygen conduit array 70 extends from the distal end portion 26 of the handle body 23, along the channel 98 on the front side of the second plate seal 54, and out the back side of the second plate seal 54. The fuel gas conduit array 72 extends from the distal end portion 26 of the handle body 23, along the channel 100 on the front side of the second plate seal 54, and out the back side of the second plate seal 54. Similarly, the cutting oxygen conduit array 74 extends from the distal end portion 26 of the handle body 23, along the shorter channel 102 on the front side of the second plate seal 54, and out the back side of the second plate seal 54.

Figure 17:
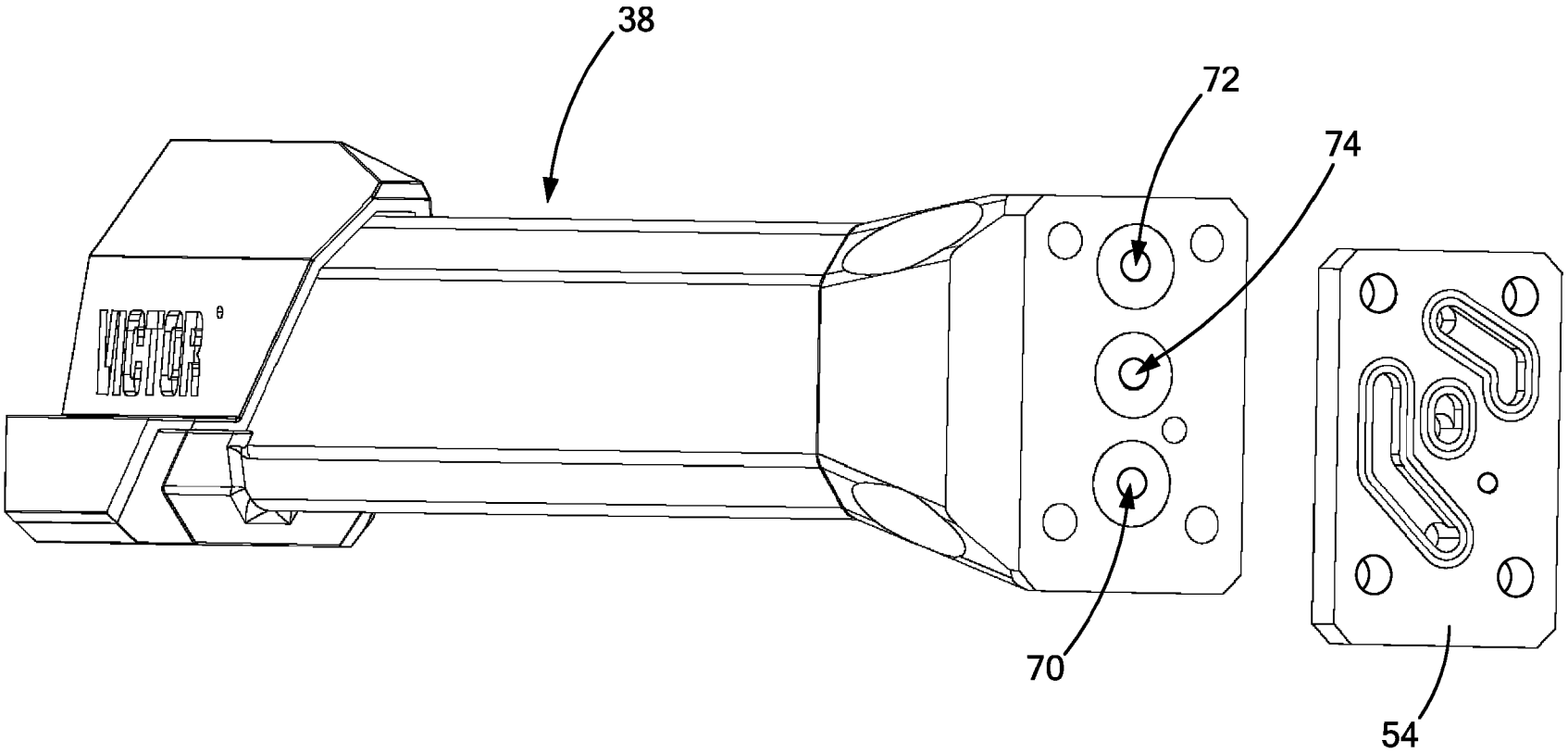
FIG. 17 is a rear exploded perspective view illustrating a tube section and the second plate seal constructed in accordance with the principles of the present disclosure.
Figure 18:
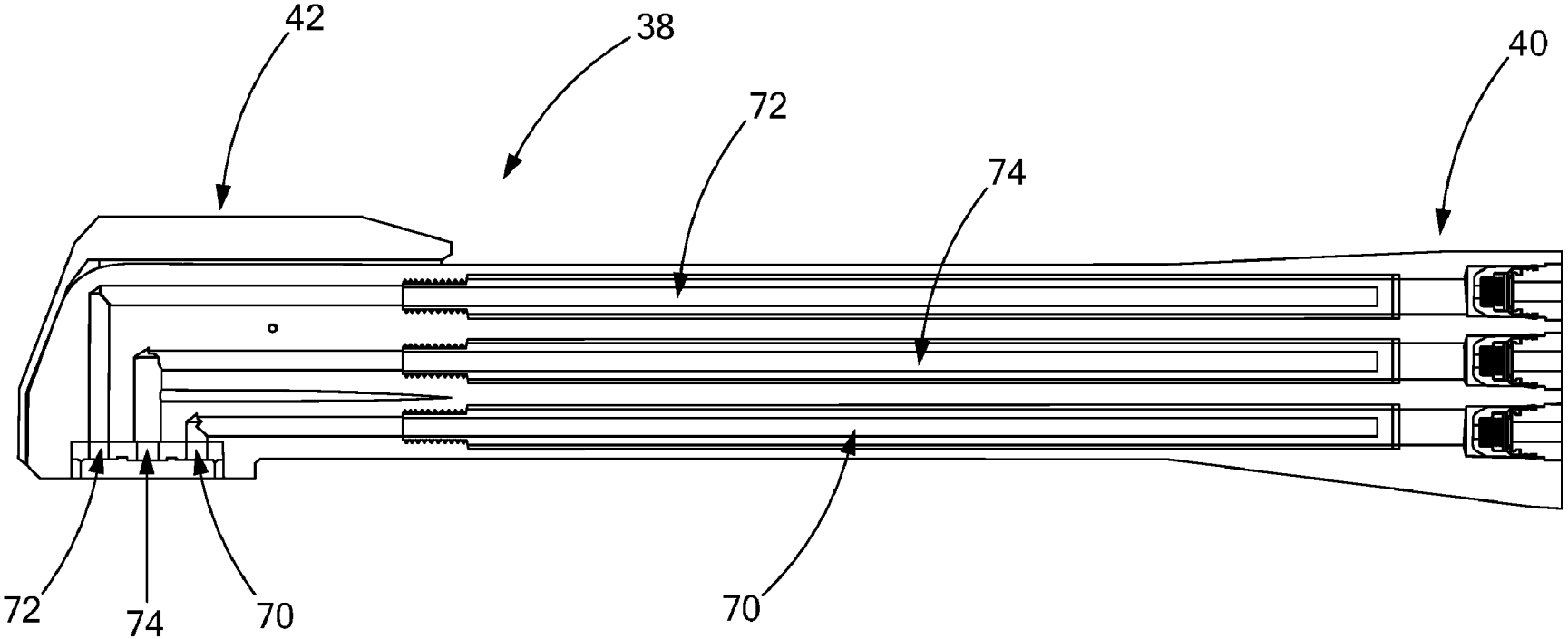
FIG. 18 is a cross-sectional view through the tube section illustrating portions of the conduit array in accordance with the principles of the present disclosure.

From here, the conduit arrays continue on to the tube section 38, as shown in FIGS. 17 and 18. The preheat oxygen conduit array 70, the fuel gas conduit array 72, and the cutting oxygen conduit array 74 extend from the proximal end portion 40 of the tube section 38 to the distal end portion 42 as shown, and then bend about 90 degrees and extend towards the cutting tip 46 (not shown).

Figure 19:
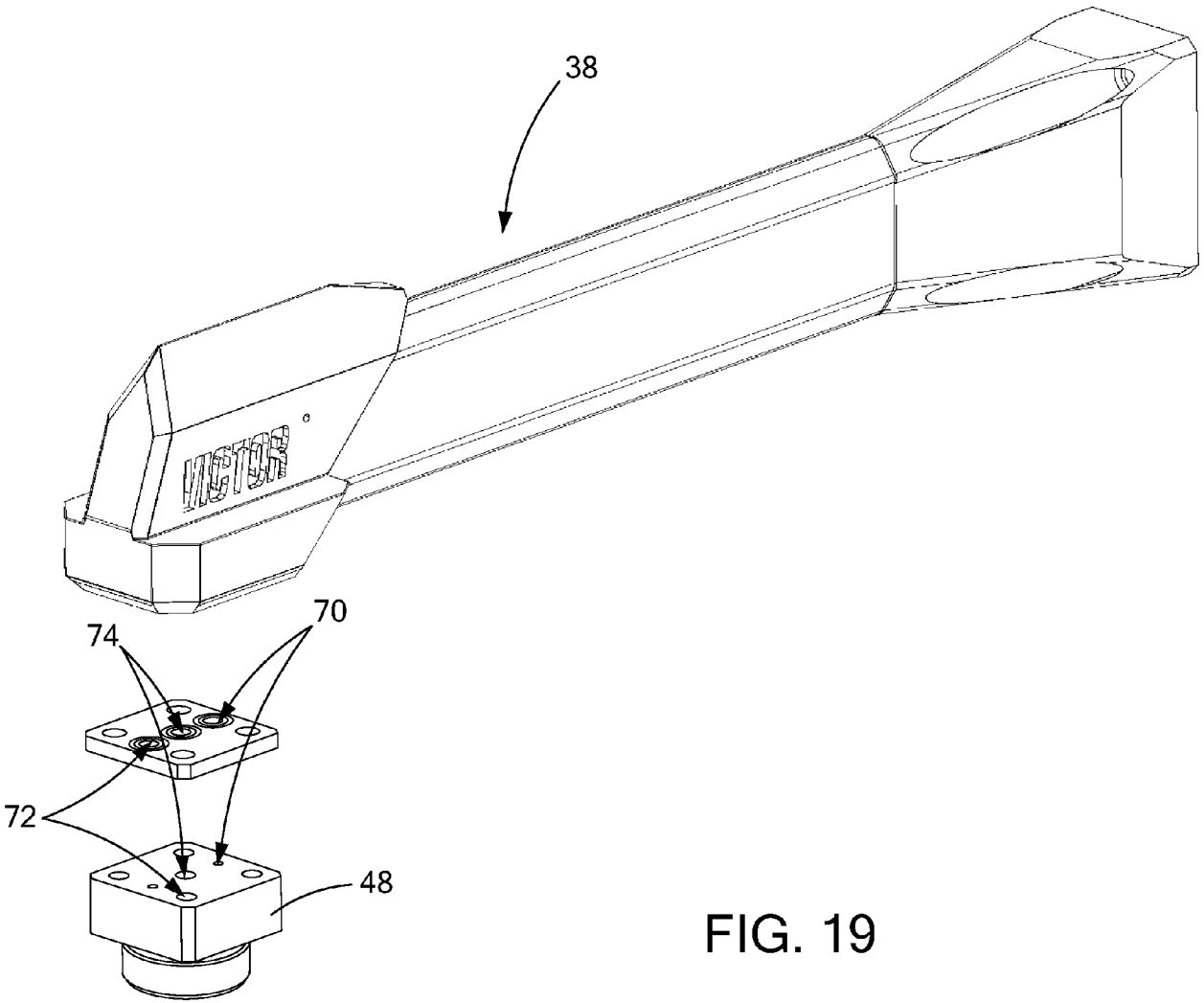
FIG. 19 is a perspective exploded view illustrating the tube section, a third plate seal, and a tip seat constructed in accordance with the principles of the present disclosure.
Figure 20:
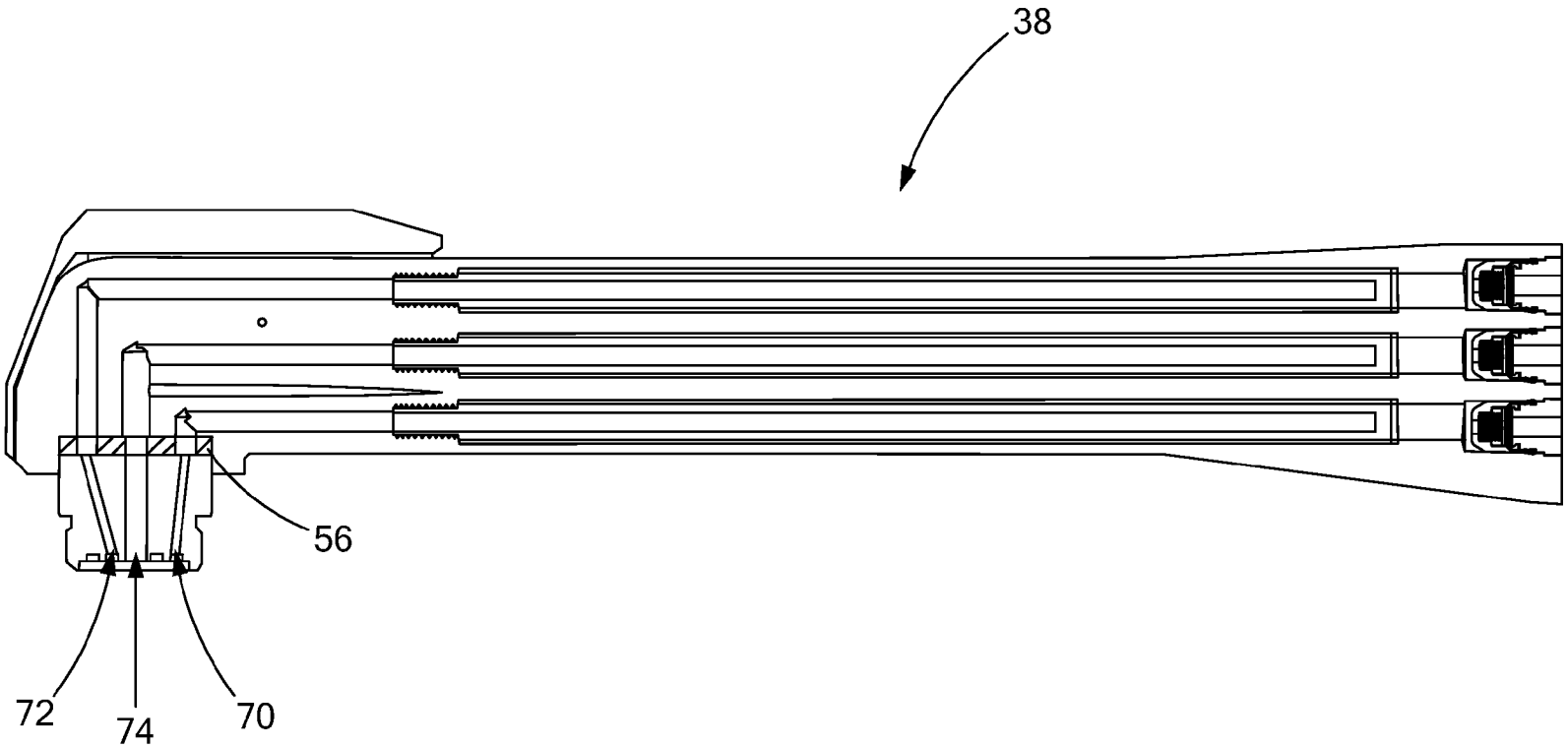
FIG. 20 is a cross-sectional view through the tube section, the third plate seal, and the tip seat illustrating portions of the conduit array in accordance with the principles of the present disclosure.
Figure 21:
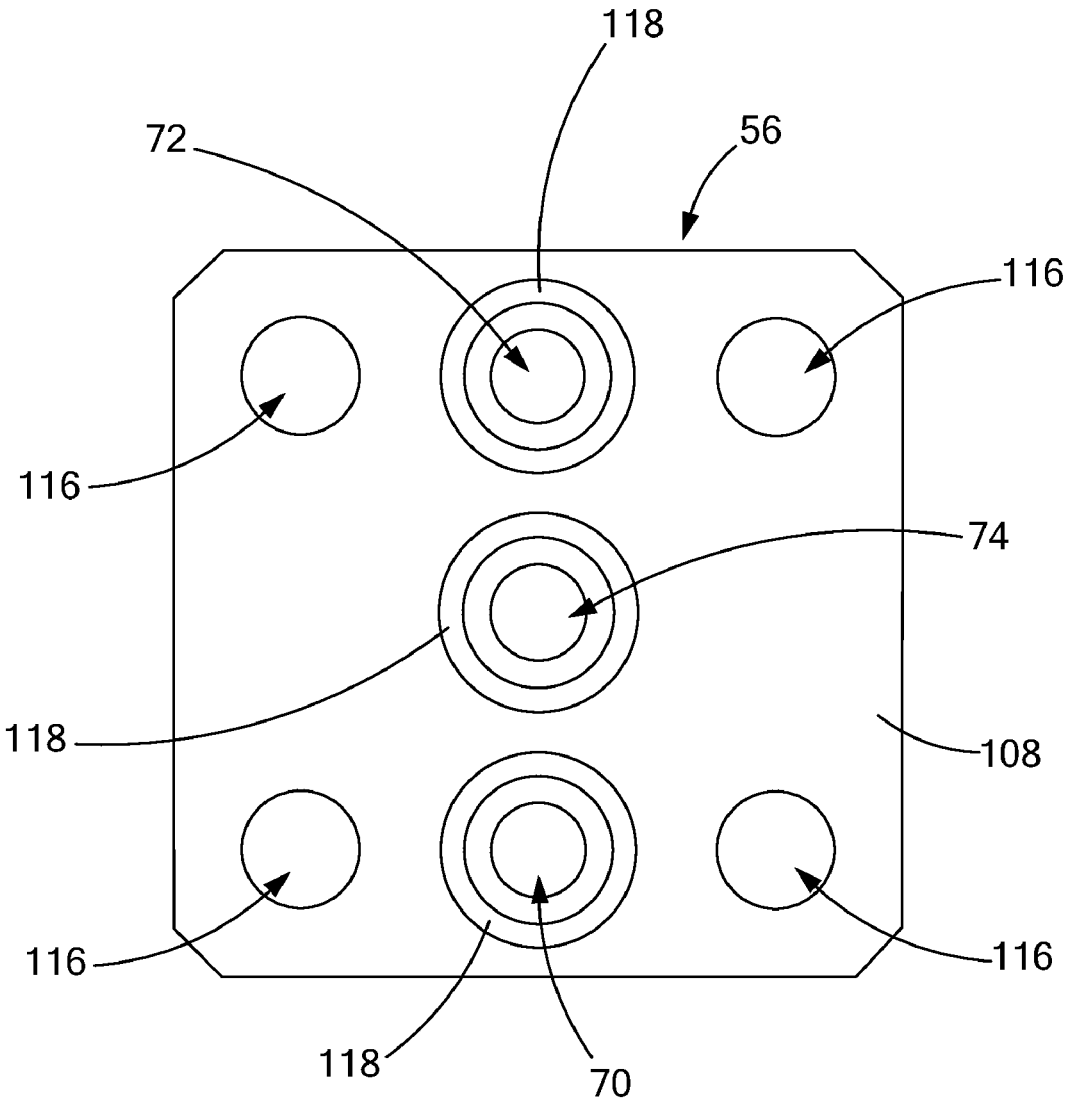
FIG. 21 is a top view of the third plate seal constructed in accordance with the principles of the present disclosure.
Figure 22:
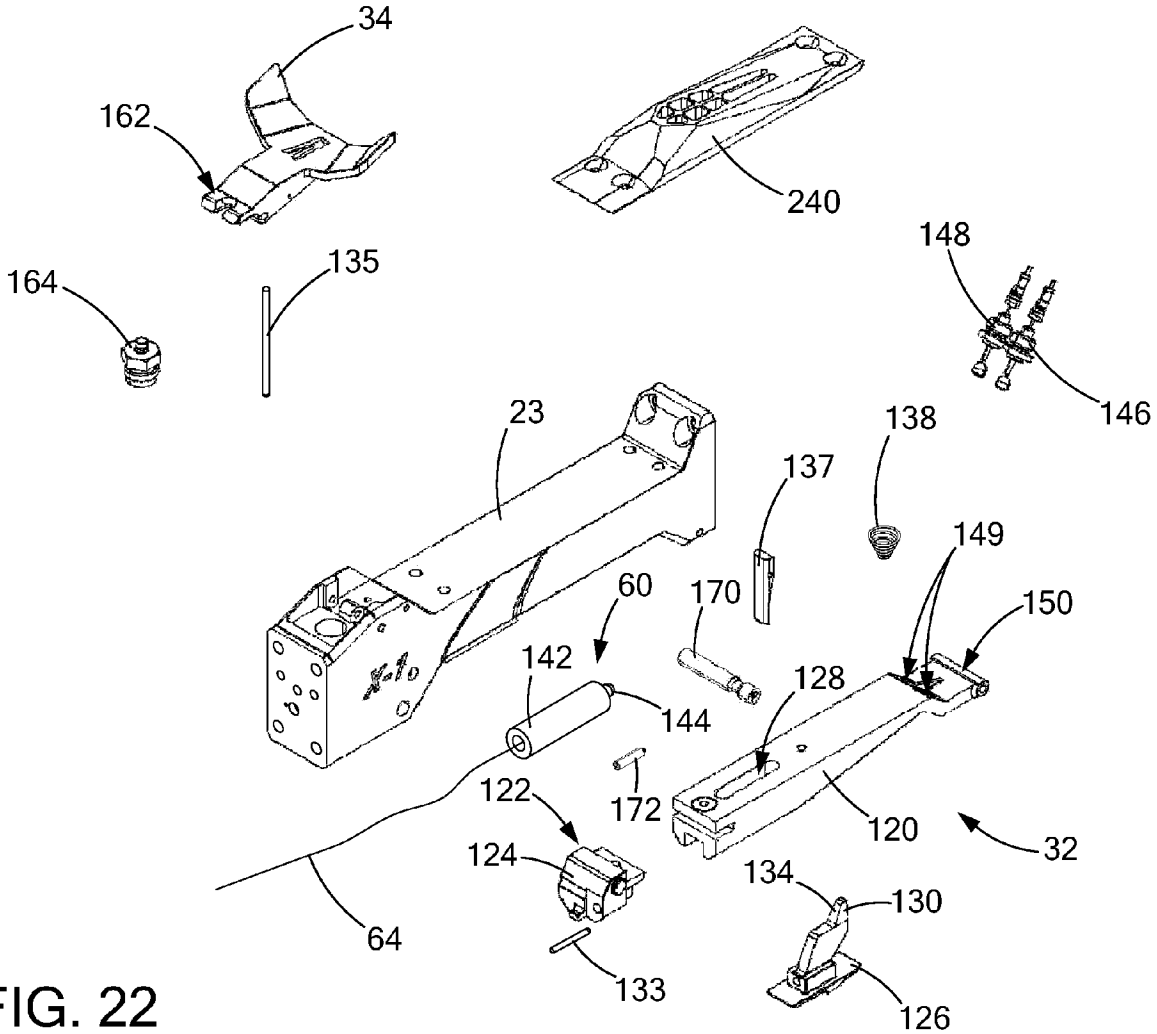
FIG. 22 is an exploded perspective view of the handle section and an ignition trigger constructed in accordance with the principles of the present disclosure.
Figure 23:
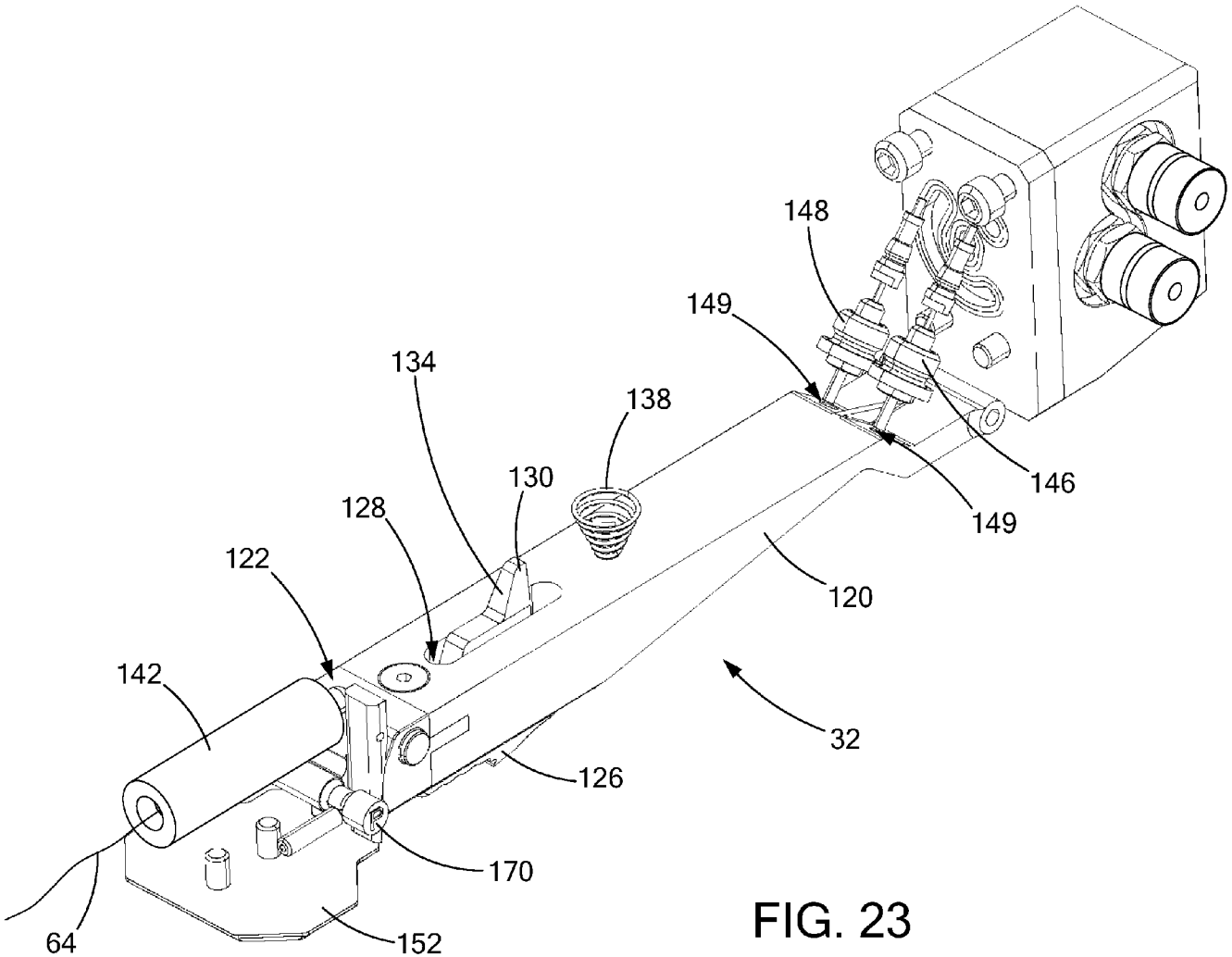
FIG. 23 is a partial perspective view illustrating the ignition trigger and gas control devices constructed in accordance with the principles of the present disclosure.

As shown in FIGS. 19-21, the conduit arrays then continue on to the third plate seal 56 and the tip seat 48 before reaching the cutting tip 46. (Flow of the gases through the cutting tip 46 is described in greater detail below). In this form, the third plate seal 56 is symmetrical from top to bottom and does not include channels as previously illustrated and described with the other plate seals. Therefore, the preheat oxygen conduit array 70, the fuel gas conduit array 72, and the cutting oxygen conduit array 74 extend throughout various components of the gas cutting torch 20 to direct the flow of their respective gases for operation, which is described in greater detail below.

Referring back to FIGS. 10*a*-10*b*, 16*a*-16*b*, and 21, the plate seals 52, 54, and 56 comprise plate bodies 104, 106, and 108, respectively, which are generally a rigid material, such as Aluminum by way of example. The various channels and apertures are formed or machined into or through the plate bodies 104, 106, and 108 as necessary. Referring first to the first plate seal 52 in FIGS. 10*a* and 10*b*, the plate body 104 includes channels 86 and 90 that direct the flow of fuel gas and cutting oxygen, respectively, and also apertures 110, which are used for securing the first plate seal 52 to the flow control unit 36 and the handle portion 22. (See FIG. 1). In one form, the first plate seal 52 is secured using mechanical fasteners, however, it should be understood that other forms of securing the plate seals may be employed while remaining within the scope of the present disclosure. Similarly, the second plate seal 54 shown in FIGS. 16*a*-16*b* includes a plate body 106 and a plurality of apertures 112 to secure the second plate seal 54 to the handle portion 22 and the tube section 38. (See FIG. 1). Again, mechanical fasteners are employed to secure these components in one form of the present disclosure. The second plate seal 54 also comprises a wire passageway 114, through which the ignition wire 64 passes. Also, the third plate seal 56 shown in FIG. 21 includes a plate body 108 and a plurality of apertures 116 to secure the third plate seal 56 to the tube section 38 and the tip seat 48. (See FIG. 1). Again, mechanical fasteners are employed to secure these components in one form of the present disclosure.

The plate seals 52, 54, and 56 also include sealing portions 118, which are generally an elastomeric material and extend or protrude from the faces of the plate bodies 104, 106, and 108. These sealing portions 118 are generally defined by the shape of the channels and gas passageways as shown. When the plate seals 52, 54, and 56 are secured to and tightened against their adjacent components (flow control unit 36, handle portion 22, tube section 38, and tip seat 48), the sealing portions 118 are compressed and thus form a seal at their interfaces. In this way, use of plate seals 52, 54, and 56 are highly advantageous since they eliminate the use of complicated forgings and machinings and also eliminate the associated brazing or soldering processes. In one form of the present disclosure, each of the gas passageways for the preheat oxygen conduit array 70, the fuel gas conduit array 72, and the cutting oxygen conduit array 74 are formed perpendicular to the faces through which they travel. Therefore, the components of the gas cutting torch 20 are much simpler and cost effective than the prior art.

Referring now to FIGS. 22-26, the ignition trigger 32 and its operation is now illustrated and described in greater detail. First of all, the ignition trigger 32 comprises a trigger body 120, including a forward portion 122 defining a cam surface 124. In one form, the forward portion 122 is a separate component from the trigger body 120, however, it should be understood that the forward portion 122 and the trigger body 120 may be a single, unitized component. The forward portion 122 is preferably a metal material, such as steel, which can withstand multiple and repeated ignitions, or engaging of the ignition system 60, as described in greater detail below, whereas the trigger body 120 is a more lightweight material such as plastic. It should be understood, however, that other materials may be employed while remaining within the scope of the present disclosure.

As further shown, the ignition trigger 32 also comprises a latch 126 disposed within a groove 128 in the trigger body 120. Generally, the latch 126 is slidably engaged within the groove 128 along the direction of arrow A. (See FIGS. 25*a* and 25*b*). In one form, the latch 126 is mounted to the trigger body 120 via a pin 129, and the latch 126 is biased forward, or distally towards the tube section 38, with a biasing member 131, which is a spring in one form of the present disclosure.

The latch 126 further comprises an upper extension 130 that is adapted to prevent the trigger body 120 from engaging the ignition system 60 without sliding the latch 126. Furthermore, the latch 126 is adapted to be received within a cavity 132 formed in the handle body. The upper extension 130 defines a ramped surface 134 that cooperates with a corresponding ramped surface 136 of the cavity 132 in the "on" position, the operation of which is described in greater detail below. In the "off" position, the upper extension 130 abuts an inner surface 140 of the handle body 23 such that the trigger body 120 cannot be moved in the direction of arrow B and thus engage the ignition system 60.

Figure 24:
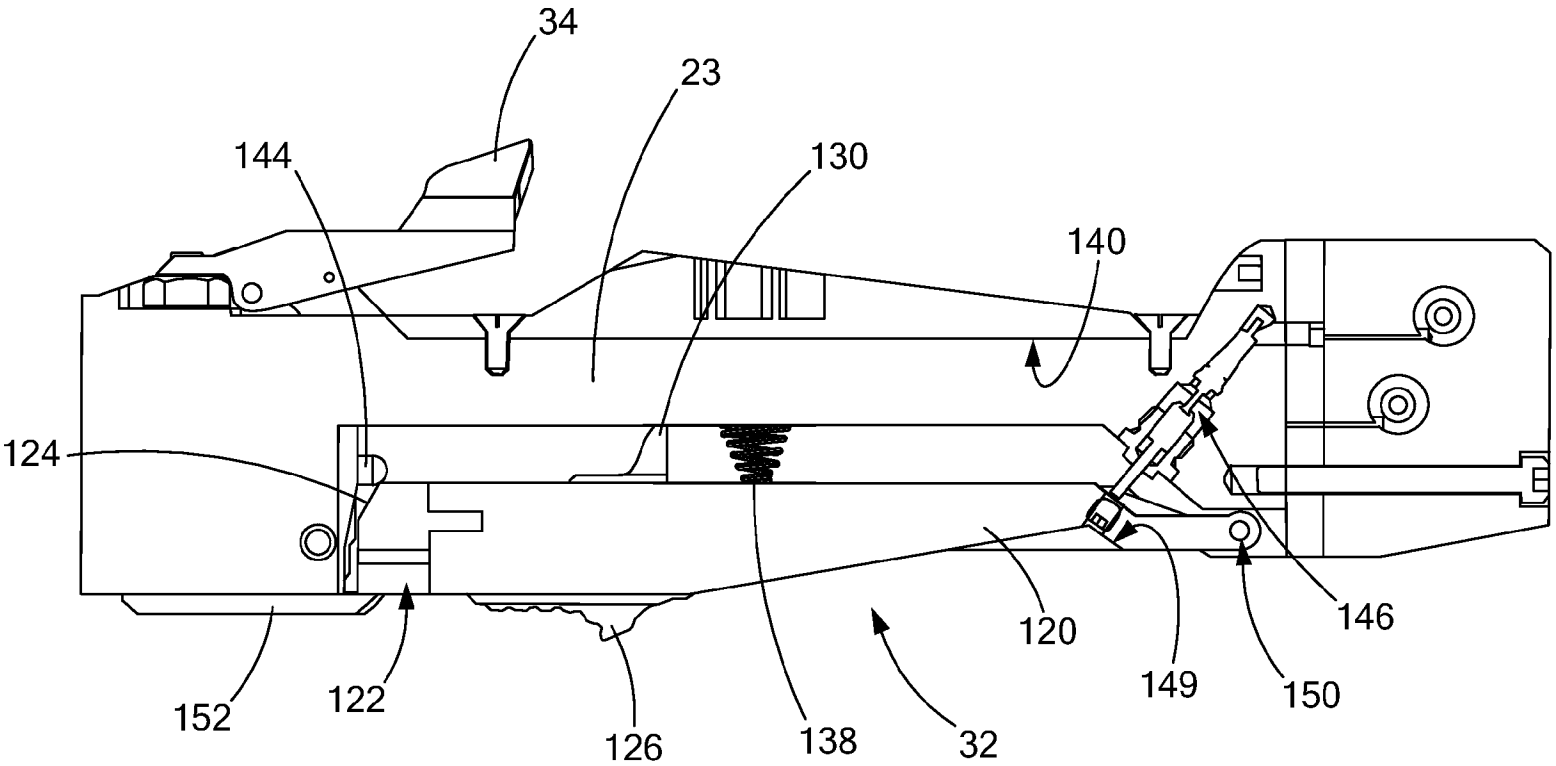
FIG. 24 is a cross-sectional view through the handle section, the ignition trigger, and a gas control device in accordance with the teachings of the present disclosure.

Also included with the ignition trigger 32 is a biasing device 138, which in one form is a coil spring as shown, which biases the ignition trigger 32 in the "off" position. More specifically, as shown in FIG. 24, the biasing device 138 abuts the inner surface 140 of the handle body 23 and the trigger body 120 and is biased to move the trigger body 120 downward, or to the "off" position. Therefore, if an operator releases the ignition trigger 32, the gas cutting torch 20 is turned off, or enters an "auto shut-off" mode, thus improving the safety of operation.

The ignition system 60 within the handle portion 22 includes a piezoelectric igniter 142 with a piston 144 extending therefrom. Additionally, gas control devices are disposed within the handle portion 22, and more specifically, a first gas control device 146 to control the flow of preheat oxygen, and a second gas control device 148 to control the flow of fuel gas. In one form, the gas control devices 146 and 148 include Schrader valves, however, it should be understood that other types of gas control devices may be employed while remaining within the scope of the present disclosure. Additionally, in an alternate form, the gas control devices 146 and 148 may be combined with the preheat oxygen and preheat fuel metering devices, 80 and 82 respectively, in order to reduce the number of gas control devices and thus the complexity of the gas cutting torch 20. The trigger body 120 defines internal receptacles 149 that are adapted to receive the gas control devices 146 and 148. Additionally, as best shown in FIGS. 24 and 25, the trigger body 120 is pivotally connected to the handle body 23 along a hinge portion 150.

Additionally, the trigger system 30 includes an interlock device 135 (which in this form is a pin as shown) that is secured to the cutting oxygen trigger 34 and functions to prevent the flow of cutting oxygen when the ignition trigger 32 is not engaged, which is described in greater detail below. A wedge block 137 is also provided as a part of the ignition trigger 32, which cooperates with the forward portion 122 and a spring plunger 133 to reduce the amount of force that is required to hold the ignition trigger 32 in the "on" position. More specifically, and with reference to FIG. 25*c*, the wedge block 137 includes a detent 139 that receives the spring plunger 133 when the ignition trigger 32 is engaged. The spring plunger 133 is mounted within the forward portion 122 as shown and is sized to overcome the spring force of the biasing device 138, thus reducing the amount of force required to hold the ignition trigger 32 in the "on" position. As further shown, the piston 144 of the piezoelectric igniter 142 is adapted to be received within a detent 123 of the forward portion 122, which also frees travel of the interlock pin 135, thus allowing travel of the cutting oxygen trigger 34 and the flow of cutting oxygen.

In operation, an operator slides the latch 126 back and pulls up on the trigger body 120. The trigger body 120 pivots about the hinge portion 150, and the internal receptacles 149 engage the gas control devices 146 and 148, and the flow of preheat oxygen and fuel gas are initiated. Further, the cam surface 124 of the forward portion 122 of the trigger body 120 engages the piston 144 of the piezoelectric igniter 142, and an ignition source is generated, which travels down the length of the ignition wire 64 to the cutting tip 46 (not shown) to start the gas cutting torch 20. The piston 144 is further engaged within the detent 123 of the ignition trigger 32 forward portion 122, and the interlock pin 135 is allowed to travel, thus permitting operation of the cutting oxygen trigger 34 and the flow of cutting oxygen. Additionally, the spring plunger 133 engages the detent 139 of the wedge block 137 to reduce operator fatigue as previously set forth. When an operator releases the latch 126, the biasing device 138 forces the trigger body 120 back down to its neutral, or "off" position. In this position, it should be further noted that travel of the trigger body 120 is limited by a protective member 152, wherein the forward portion 122 of the ignition trigger 32 abuts the protective member 152 as shown.

In summary, the ignition trigger 32 according to the present disclosure initiates the flow of preheat oxygen and fuel gas, while also initiating ignition with a single motion by the operator. Therefore, the gas cutting torch 20 can advantageously be started with the use of only one-hand, or in other words, is configured for single-hand operation once the preheat oxygen and preheat fuel are properly set. Additionally, the ignition trigger 32 is configured for "auto shut-off" as set forth above, wherein the gas cutting torch 20 automatically shuts off when the ignition trigger 32 is released, whether intentionally or accidentally, thus improving the safety of the gas cutting torch 20.

Figure 25A:
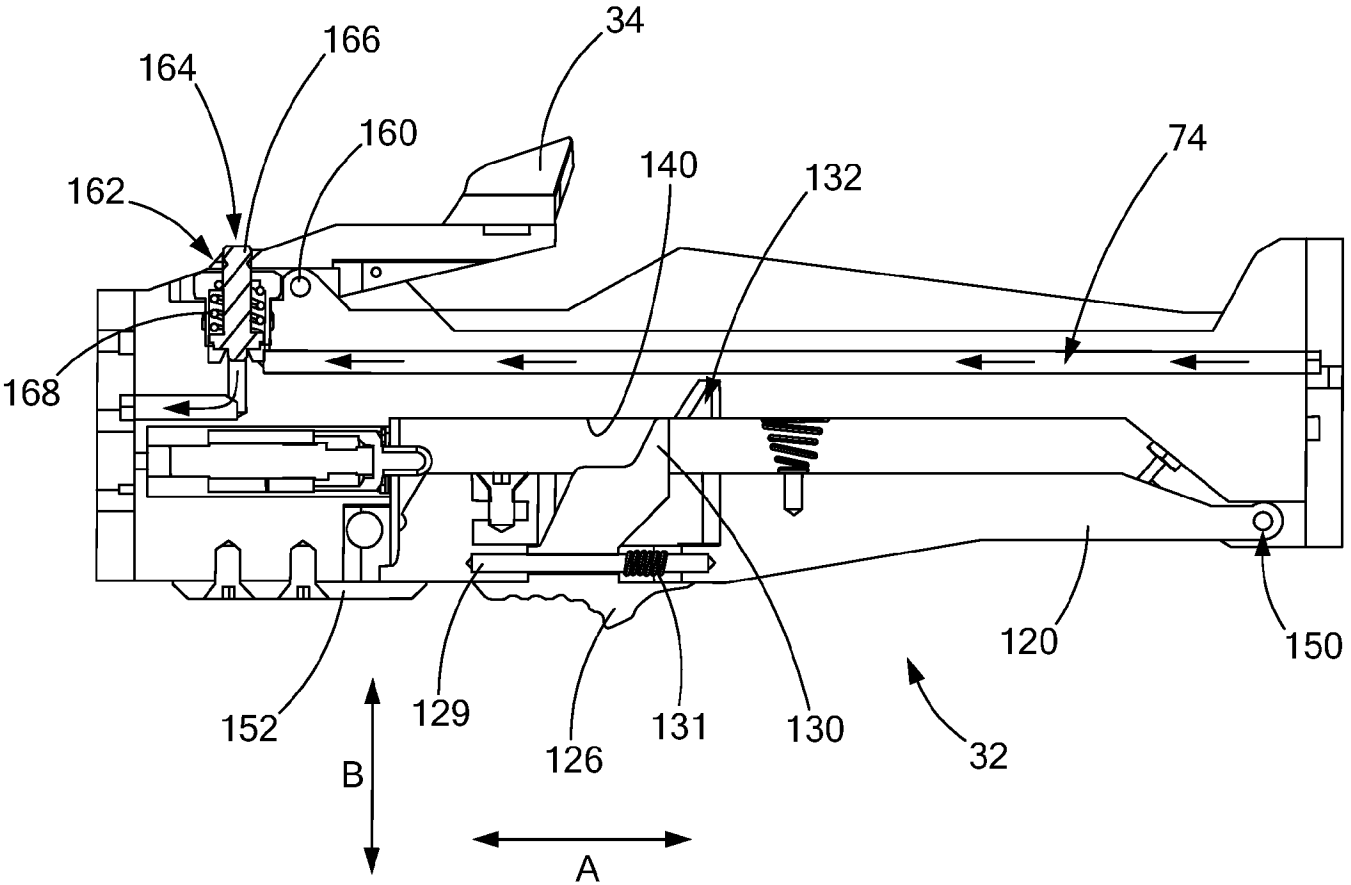
FIG. 25*a* is a cross-sectional view through the handle section and ignition trigger, illustrating a latch of the ignition trigger in an "off" position and constructed in accordance with the principles of the present disclosure.
Figure 25B:
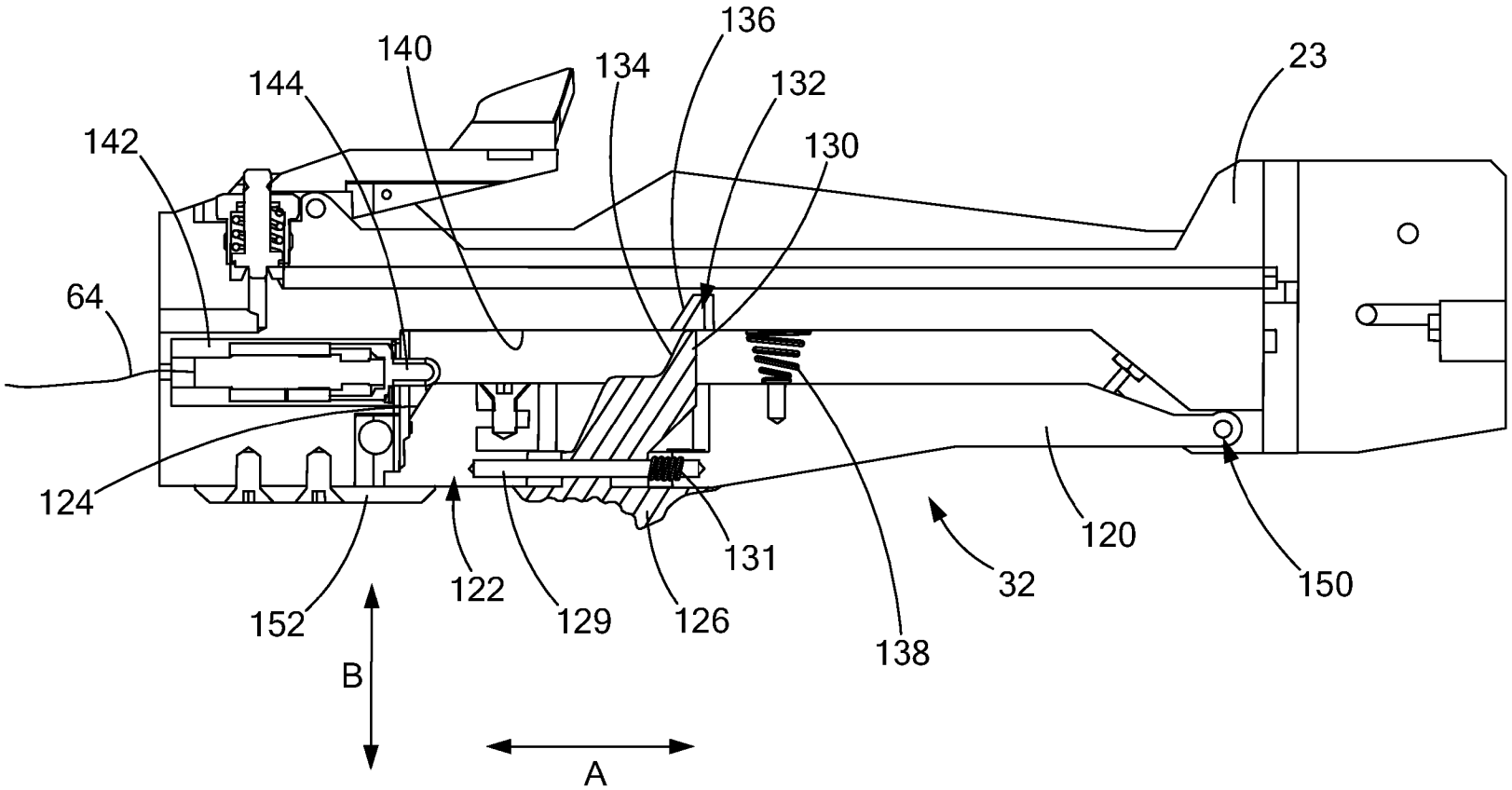
FIG. 25*b* is a cross-sectional view through the handle section and ignition trigger, illustrating a latch of the ignition trigger in an "on" position and constructed in accordance with the principles of the present disclosure.
Figure 25C:
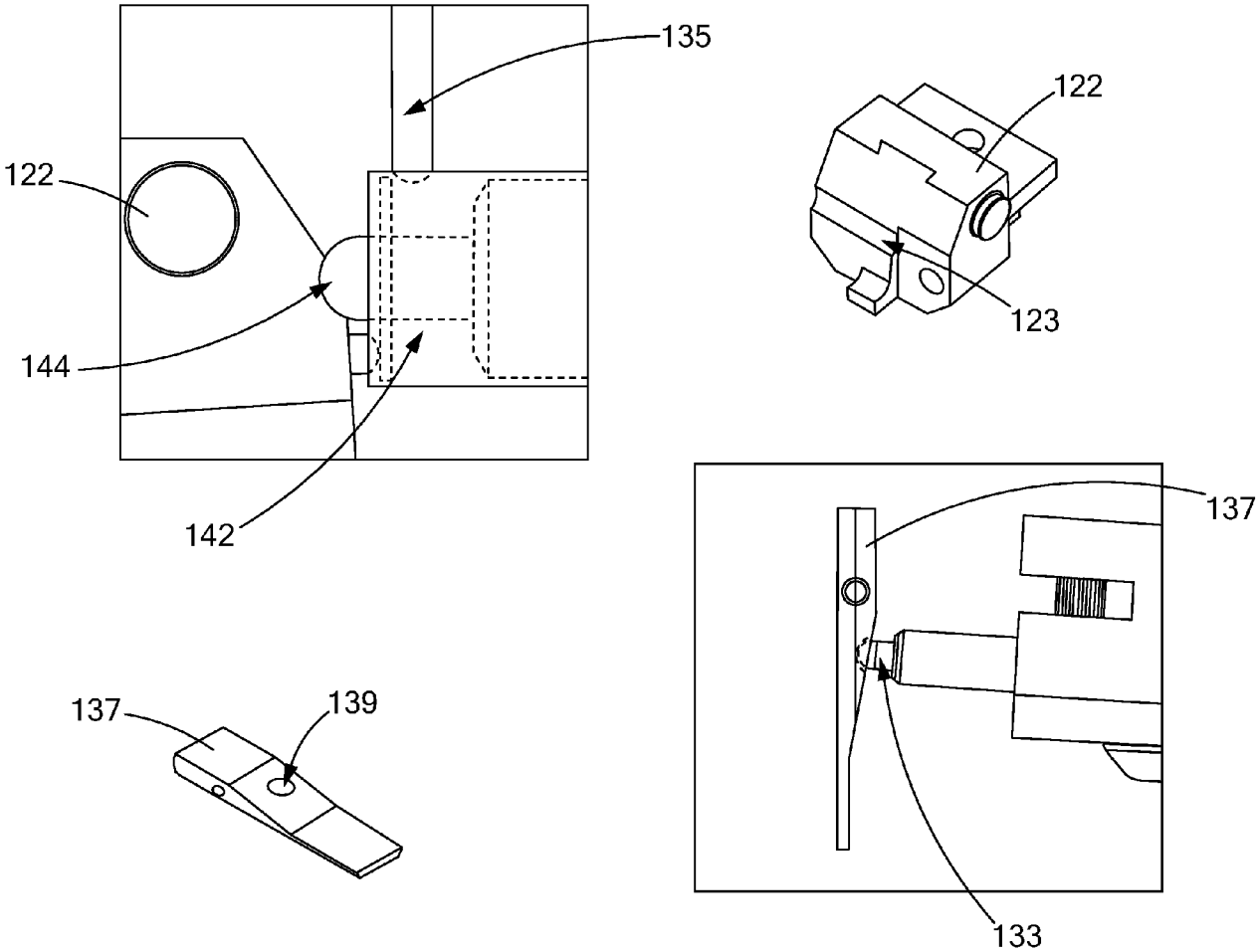
FIG. 25*c* is several 3D views of various components of the ignition trigger constructed in accordance with the principles of the present disclosure.

The trigger system 30 also includes the cutting oxygen trigger 34, which is preferably mounted to an upper distal end of the handle portion 22 as shown. As best shown in FIG. 25*a*, the cutting oxygen trigger 34 is pivotally mounted to the handle body 23 with a pin 160 and includes a lifting portion 162 (see also FIG. 22) that is adapted to engage a third gas control device 164, which in this form is a plunger valve. The cutting oxygen trigger 34 also includes the interlock pin 135 as previously set forth, which prevents movement of the cutting oxygen trigger 34 when the ignition trigger 32 is not engaged. After the ignition trigger 32 is engaged, when a user depresses the cutting oxygen trigger 34, the lifting portion 162 engages the third gas control device 164, and more specifically, lifts a plunger 166, which allows cutting oxygen to flow through the cutting oxygen conduit array 74. Subsequently, when the user releases the cutting oxygen trigger 34, a biasing member 168 (which is a spring in one form of the present disclosure) of the third gas control device 164 forces the plunger 166 back down to its neutral position to stop the flow of cutting oxygen. The third gas control device 164 is thus in communication with the cutting oxygen trigger 34 and the cutting oxygen conduit array 74 to control the flow of cutting oxygen.

Figure 26:
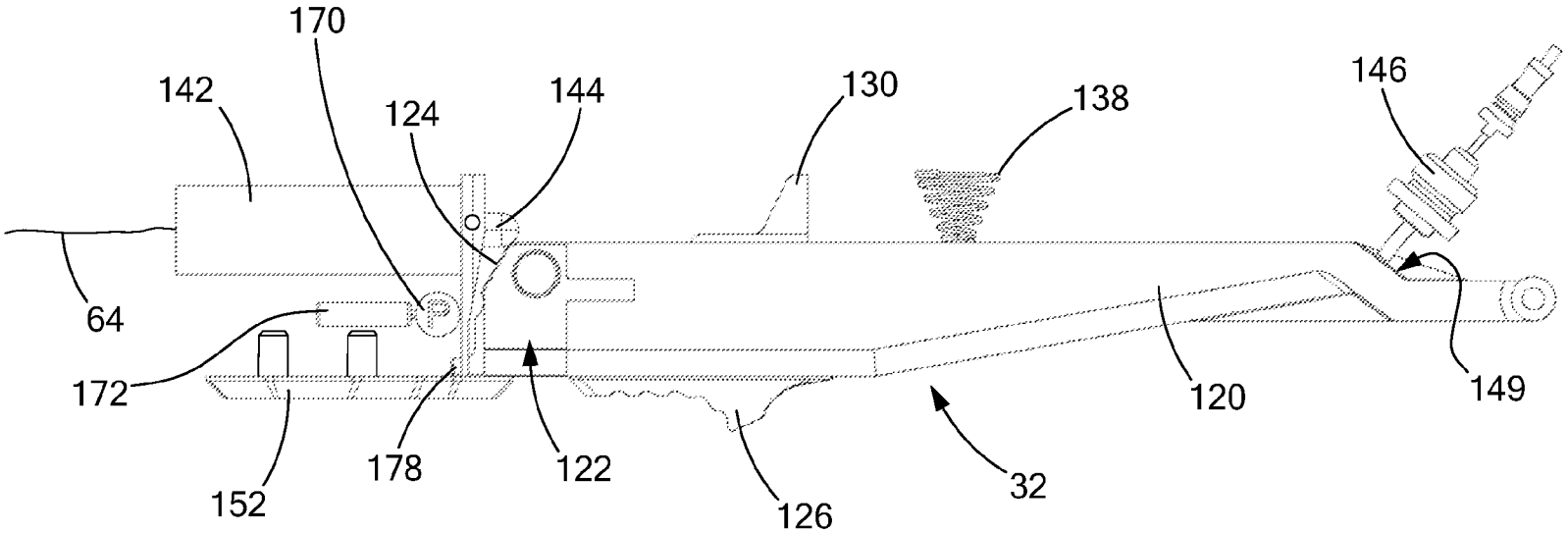
FIG. 26 is a side view of the ignition trigger and a purge selector constructed in accordance with the principles of the present disclosure.
Figure 27A:
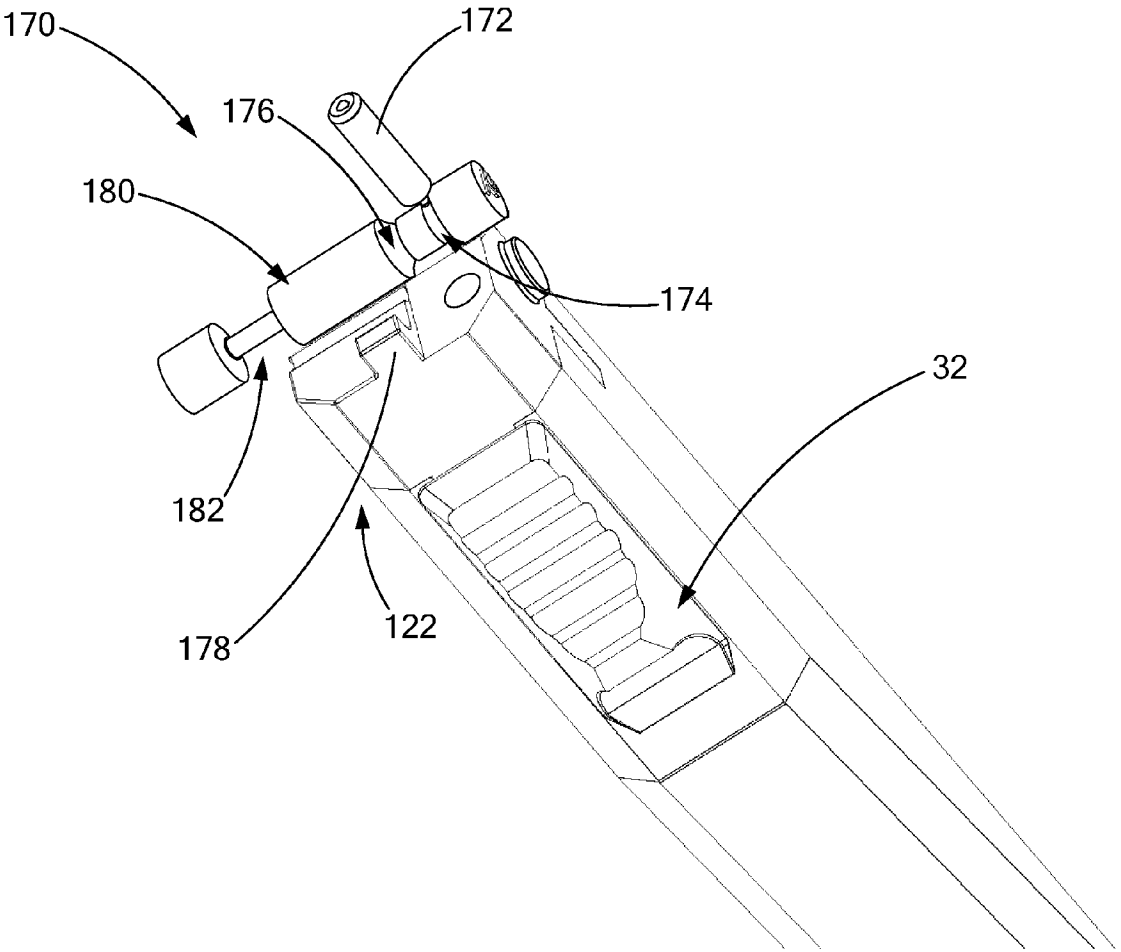
FIG. 27*a* is a perspective bottom left side view of certain components of a trigger system and the purge selector constructed in accordance with the principles of the present disclosure.
Figure 27B:
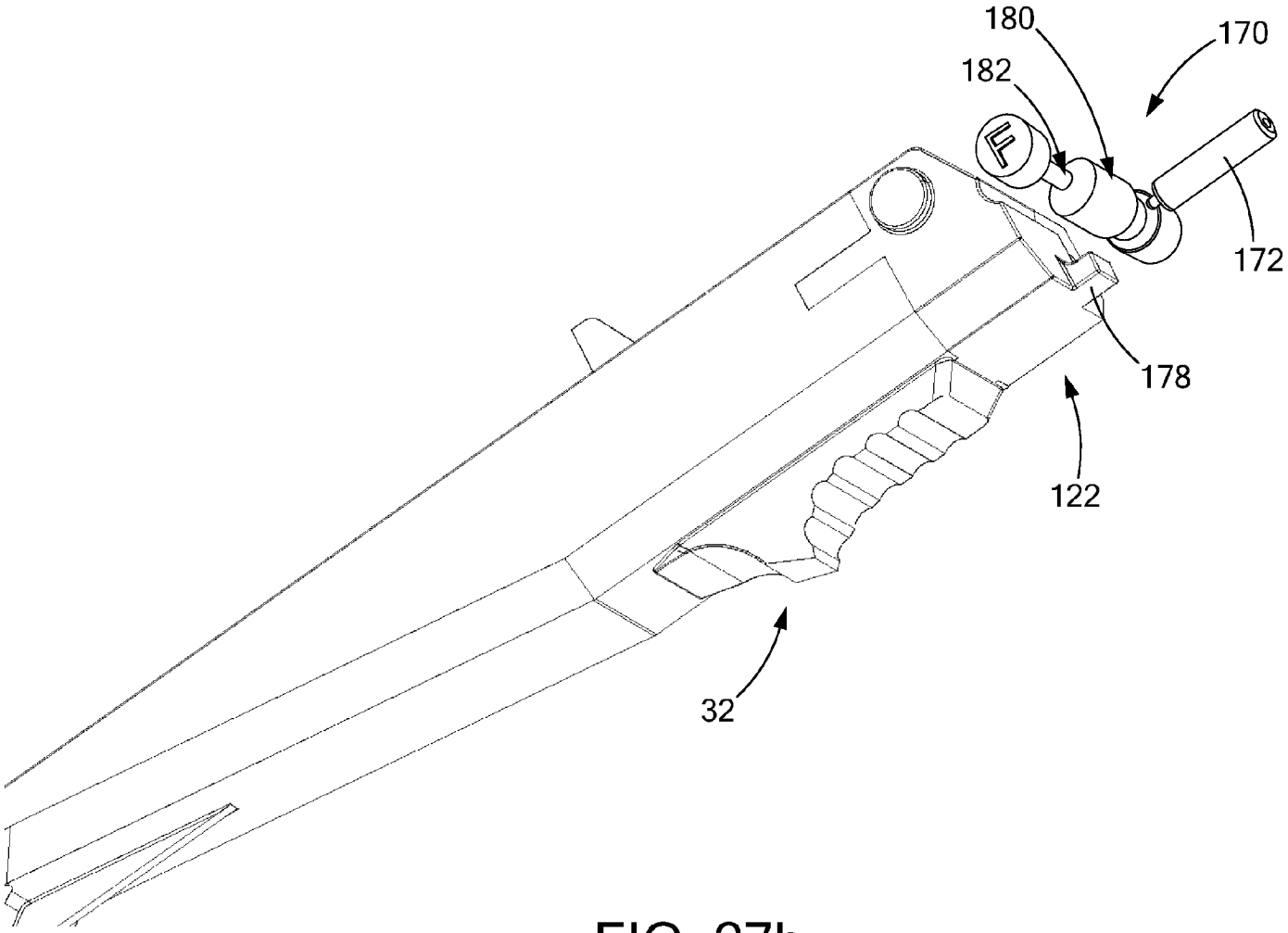
FIG. 27*b* is a perspective bottom right side view of the components of a trigger system and the purge selector in accordance with the principles of the present disclosure.

As further shown, a purge selector 170 is also disposed within the handle portion 22. The purge selector 170 is slidably mounted to the handle body 23 and thus slides from left to right when depressed or pushed from either side. Referring specifically to FIGS. 26, 27*a*, and 27*b*, a spring plunger 172 is also provided that engages detent grooves 174 and 176 formed in the purge selector 170 to hold the purge selector 170 in either the "purge" position or the "fire" position. In the "purge" position, or when the purge selector 170 is depressed, the spring plunger 172 engages the detent groove 174 and a tab 178 formed on the forward portion 122 of the ignition trigger 32 engages a central portion 180 of the purge selector 170 to limit travel of the ignition trigger 32. In this purge position, the preheat oxygen and fuel gas are allowed to flow through their respective conduit arrays while the ignition system 60 is disabled, therefore purging gases from the gas cutting torch 20. Conversely, when the other side of the purge selector 170 is depressed, or the "fire" position is engaged, the spring plunger 172 engages the detent groove 176 and the tab 178 is free to travel further within a groove 182 formed in the purge selector 170. In this fire position, the preheat oxygen and fuel gas are allowed to flow, and the ignition system 60 is enabled. As further shown, visual indicators may be provided on the purge selector itself, such as "P" for purge on one side, and "F" for fire on the other side. It should be understood that other visual or cognitive indicators may be provided while remaining within the scope of the present disclosure. Moreover, the protective member 152 extends horizontally beyond the ends of the purge selector 170 as shown in order to prevent inadvertent movement of the purge selector 170 in the event that the gas cutting torch 20 is dropped or makes inadvertent contact with another object near the purge selector 170 during use.

Figure 28:
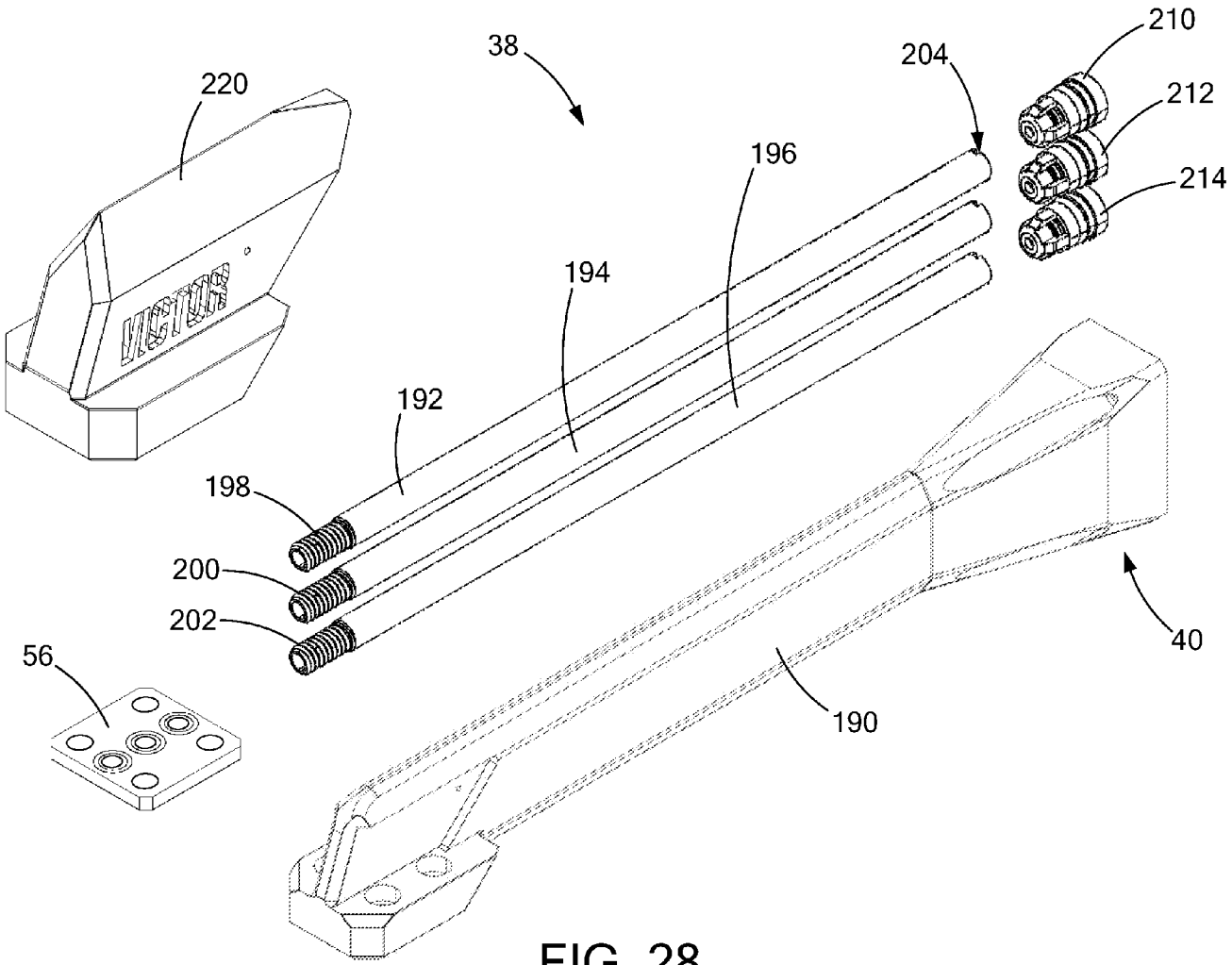
FIG. 28 is an exploded perspective view of components of the tube section of the gas cutting torch constructed in accordance with the principles of the present disclosure.
Figure 29:
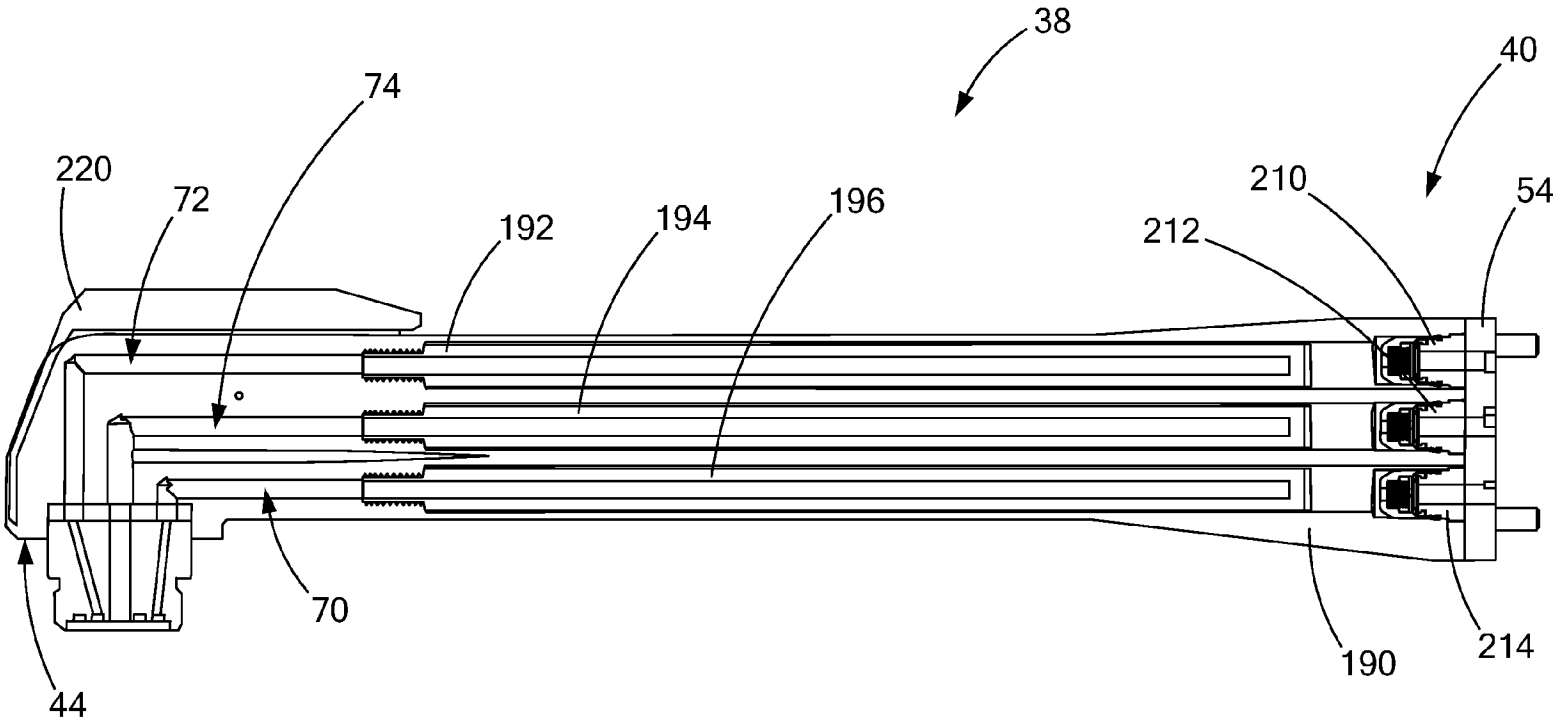
FIG. 29 is a cross-sectional view taken through the tube section of the gas cutting torch in accordance with the principles of the present disclosure.
Figure 30:
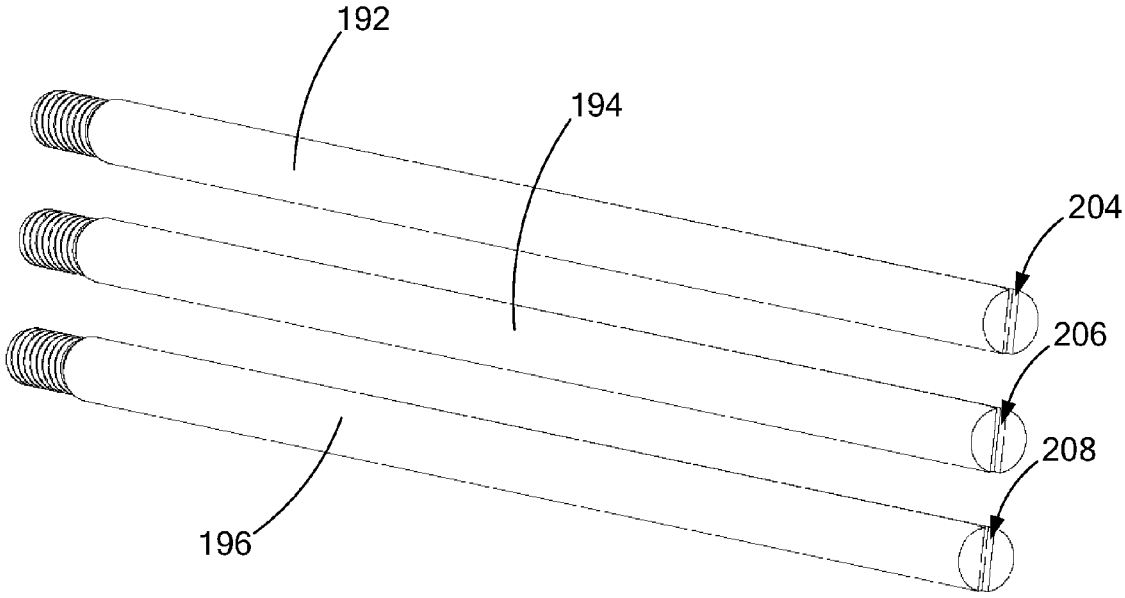
FIG. 30 is a perspective view of one form of flashback arrestors constructed in accordance with the principles of the present disclosure.
Figure 31:
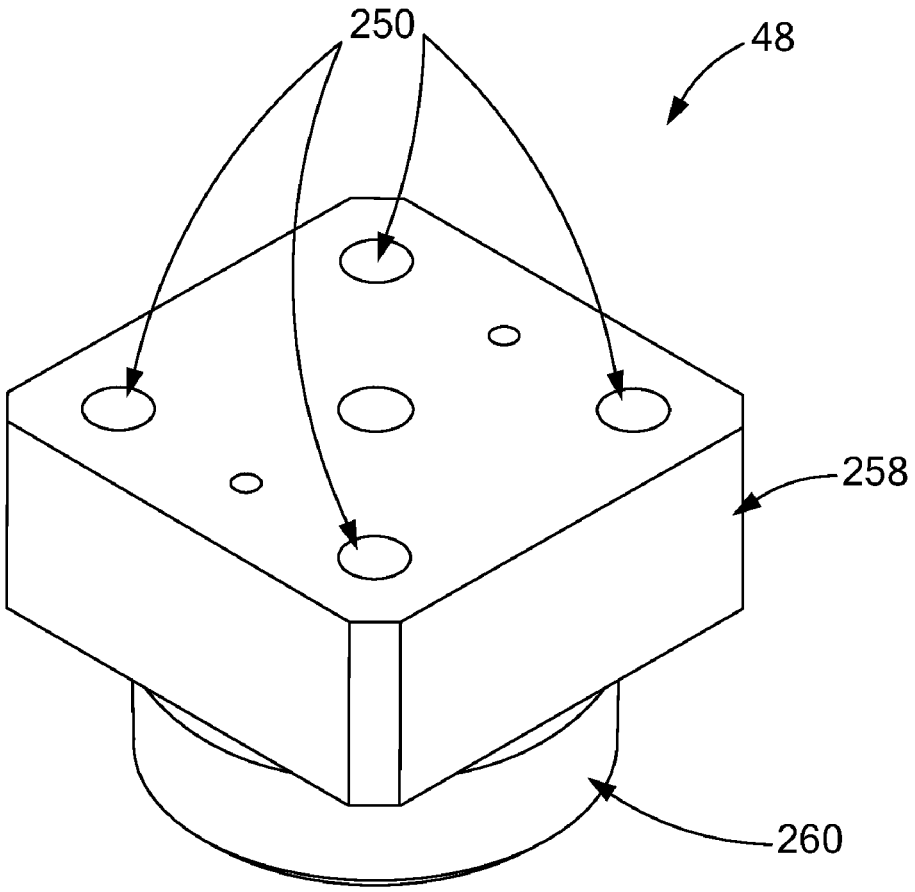
FIG. 31 is a perspective top view of a tip seat constructed in accordance with the principles of the present disclosure.
Figure 32:
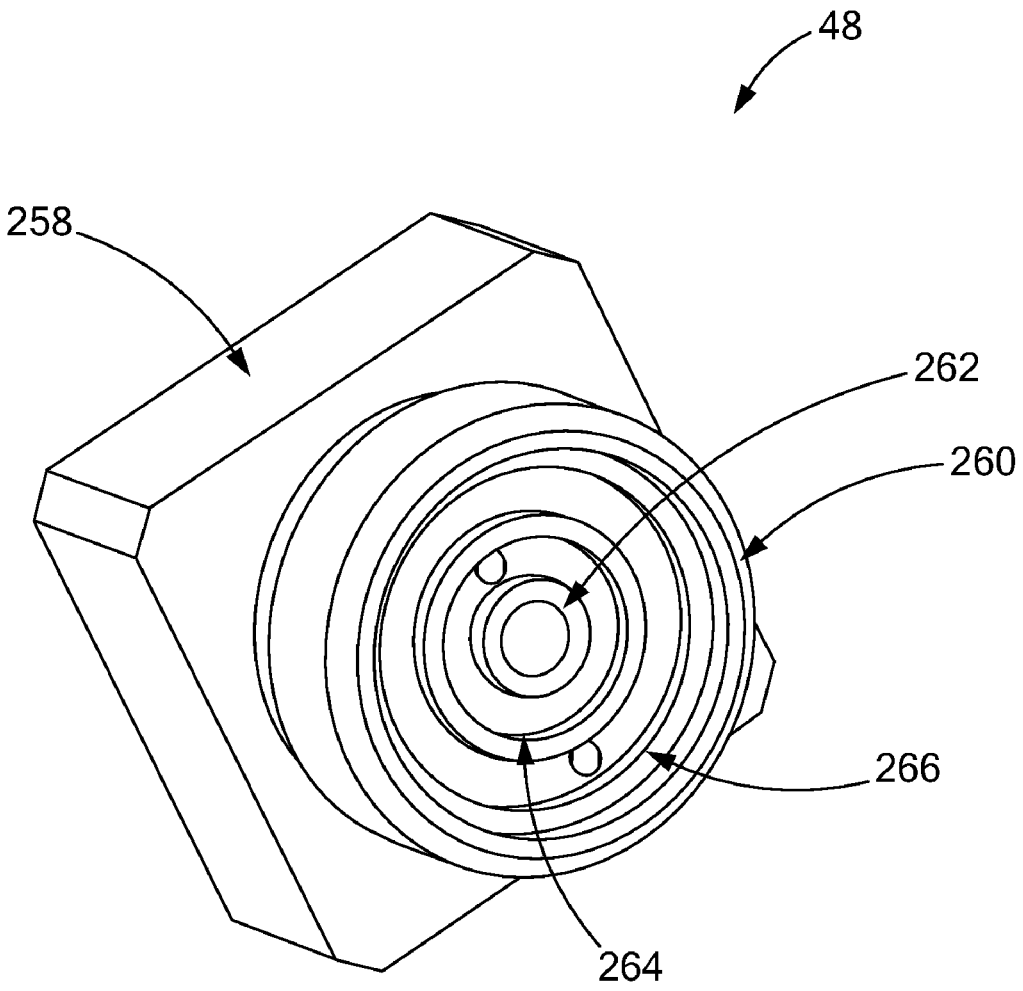
FIG. 32 is a perspective bottom view of the tip seat in accordance with the principles of the present disclosure.
Figure 33:
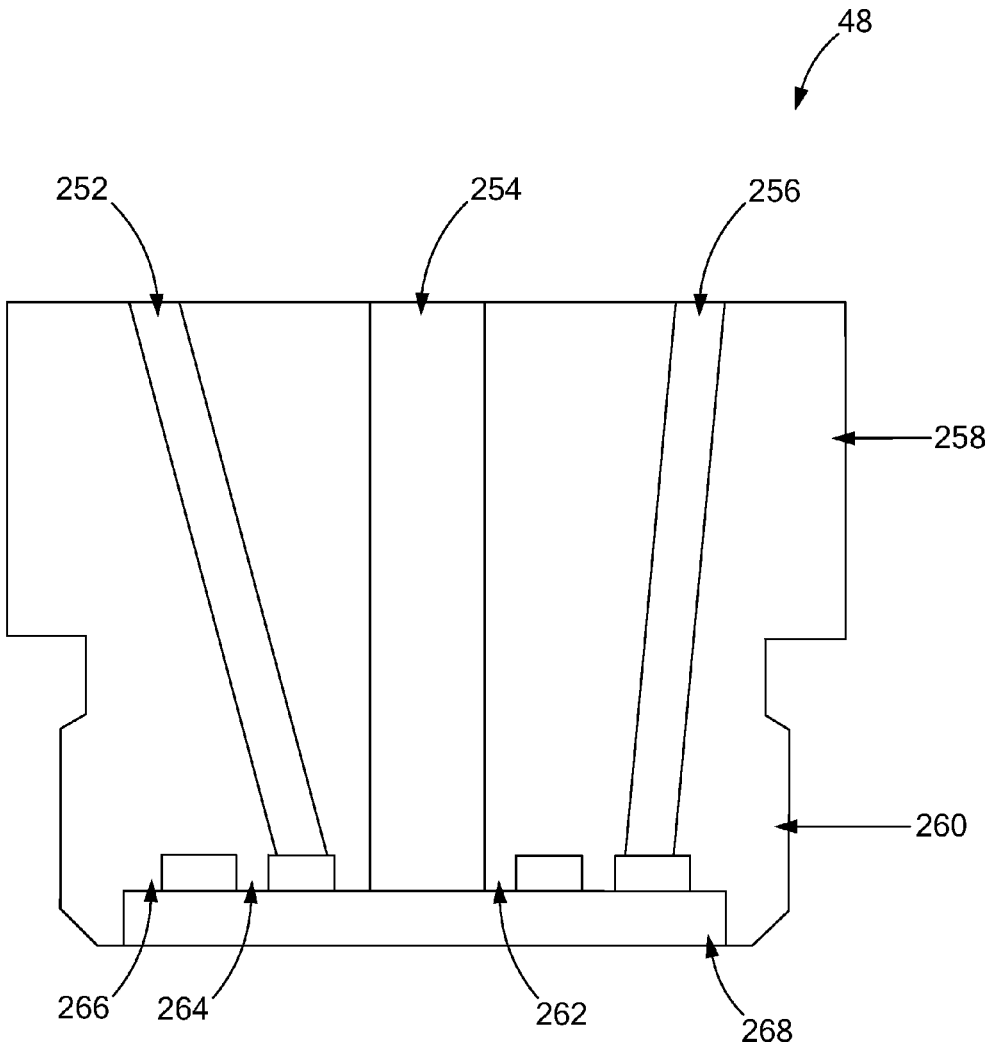
FIG. 33 is a cross-sectional view of the tip seat in accordance with the principles of the present disclosure.

Referring now to FIGS. 28 and 29, further details of the tube section 38 are now illustrated and described in greater detail. The tube section 38 generally comprises a tube section housing 190 that is secured to the second plate seal 54 and the handle portion 22 (not shown) using mechanical fasteners as previously set forth. As such, the tube section 38 is interchangeable such that other configurations of tube sections (e.g., length, orientation, shape factor, etc.) may be easily interchanged on the gas cutting torch 20. As further shown, the tube section 38 also comprises a plurality of flashback arrestors 192, 194, and 196 in one form of the present disclosure. The flashback arrestors 192 (within the fuel gas conduit array 72), 194 (within the cutting oxygen conduit array 74), and 196 (within the preheat oxygen conduit array 70) are removably secured within the tube section housing 190, such as, by way of example, threads 198, 200, and 202, respectively. With the threads being located within a blind opening, the flashback arrestors 192, 194, and 196 are outfitted with tool recesses 204, 206, and 208 (best shown in FIG. 30) around their proximal ends as shown. The tool recesses 204, 206, and 208 may be configured to accept a variety of tools and in one form define a Torx® recess (not shown). Additionally, the flashback arrestors 192, 194, and 196 may be configured such that the tool recesses 204, 206, and 208 are formed on the same end (opened end) of the flashback arrestors as the threads 198, 200, and 202, thereby reducing the amount of torque applied to the threads during installation and removal and also providing for easier removal should the flashback arrestors become inadvertently broken. As such, the flashback arrestors 192, 194, and 196 can be easily installed and removed from the tube section 38. Additionally, since the flashback arrestors 192, 194, and 196 have a relatively high length to width (or diameter) ratio, they are high volume, high flow rate, and are particularly effective in suppressing any flashback that may occur during operation. The flashback arrestors 192, 194, and 196 in one form are the same size such that they are interchangeable within each of the conduit arrays 70, 72, and 74, although the flashback arrestor 194 as used in the cutting oxygen conduit array 74 may be larger in some forms of the present disclosure. The flashback arrestors 192, 194, and 196 and preferably made of a sintered stainless steel material, although it should be understood that other types of materials may be employed while remaining within the scope of the present disclosure. It should be understood that although the flashback arrestors 192, 194, and 196 are shown configured for the tube section 38, flashback arrestors may be employed throughout other components of the gas cutting torch 20 (such as the within the flow control unit 36), while remaining within the scope of the present disclosure.

As further shown, the tube section 38 further comprises a plurality of check valves 210, 212, and 214, each disposed at the proximal end portion 40 and distally from the second plate seal 54. The check valves 210, 212, and 214 are each disposed within the fuel gas conduit array 72, the cutting oxygen conduit array 74, and the preheat oxygen conduit array 70 as shown. These check valves 210, 212, and 214 and are yet another safety feature of the gas cutting torch 20, in that any gas flow back towards the handle portion 22 is prevented through the use of the check valves 210, 212, and 214. The check valves 210, 212, and 214 are also readily interchangeable and are positioned for ease of repair or replacement.

The tube section 38 also includes a head cover 220, which is interchangeably secured to the gas cutting torch 20 proximate the head portion 44. The head cover 220 provides protection for the head portion 44 of the gas cutting torch 20, such as when a user unwittingly employs the gas cutting torch 20 as a hammering device, or when a user is attempting to remove slag or other debris from the gas cutting torch 20. Additionally, various graphics or indicia may be provided on the head cover 220, including a company logo as shown, among others. As such, the head cover 220 provides both protection and a unique physical appearance that can be customized for each end user.

Referring back to FIGS. 1-2 and 9, the flow control unit 36 is shown with the preheat oxygen metering device 80 and the preheat fuel gas metering device 82. These metering devices 80 and 82 are in communication with the preheat oxygen conduit array 70 and the fuel gas conduit array 72, respectively, and are adapted to adjust the volume flow of respective gases through these conduit arrays for ignition. As shown, the preheat oxygen metering device 80 and the preheat fuel gas metering device 82 are thumb knobs, however, it should be understood that other forms of gas metering devices may be employed while remaining within the scope of the present disclosure. Additionally, as shown in FIG. 9, various indicia 230 may be provided on the knobs and/or on the flow control unit 36 to indicate proper gas settings for a particular type of cutting operation or for certain cutting parameters. Moreover, the knobs may be colored in order to indicate the type of gas that is being controlled, such as red for the preheat fuel gas and green for the preheat oxygen.

Turning now to FIGS. 1-3 and 22, the handle portion 22 of the gas cutting torch 20 includes a palm grip 240, which is removably secured to the handle body 23. In one form, the palm grip 240 is removably secured by way of mechanical fasteners, although it should be understood that other means of securing the palm grip 240, such as snap-in features, may be employed while remaining within the scope of the present disclosure. As shown, the palm grip 240 extends upward in a ramped fashion and is configured to ergonomically accommodate the palm of a user so that repeated operations of the gas cutting torch 20 are more comfortable and less tiring to the user. Since the palm grip 240 is interchangeable, various shapes and sizes may be employed, including both a left handed and a right handed configuration, to meet the needs of individual end users. The palm grip 240 in one form is a molded plastic material and may also include additional overmold materials for resiliency and/or gripping effect.

Referring to FIGS. 1 and 31-33, the tip seat 48 is illustrated and now described in greater detail. The tip seat 48 includes four (4) mounting holes 250, through which mechanical fasteners secure the tip seat 48 to the head portion 44 of the gas cutting torch 20. In this way, the tip seat 48 is interchangeable such that different tip seats may be employed according to different application requirements. The tip seat 48 also comprises gas passageways 252, 254, and 256 that form a part of the conduit arrays for the fuel gas, cutting oxygen, and preheat oxygen, respectively. The tip seat 48 further comprises a base portion 258 and an annular extension 260. The annular extension 260 comprises a plurality of annular ridges 262, 264, and 266, which separate and seal the flows of cutting oxygen, fuel gas, and preheat oxygen. Additionally, a recess 268 is formed at a distal end of the annular extension 268 to accommodate the cutting tip 46, which is described in greater detail below. The cutting tip 46 is secured to the tip seat 48 with a locking nut 270, which is shown in FIGS. 1-3, and is engaged by a threaded connection in one form of the present disclosure. It should be understood that other forms of a locking nut 270 that do not require a tool, such as a quick-disconnect device, may be employed while remaining within the scope of the present disclosure. In this form of the tip seat 48, the gas passageways 252 and 256 for fuel gas and preheat gas, respectively, are configured symmetrically such that a 180 degree rotation of the tip seat 48 would conveniently switch the fuel gas and the preheat gas flowing into the cutting tip 46. Such a configuration is primarily for development purposes and a production version of the tip seat 48 would preferably have the gas passageways 252 and 256 configured such that they could not be inadvertently switched, i.e. "Murphy-Proofed."

Figure 34:
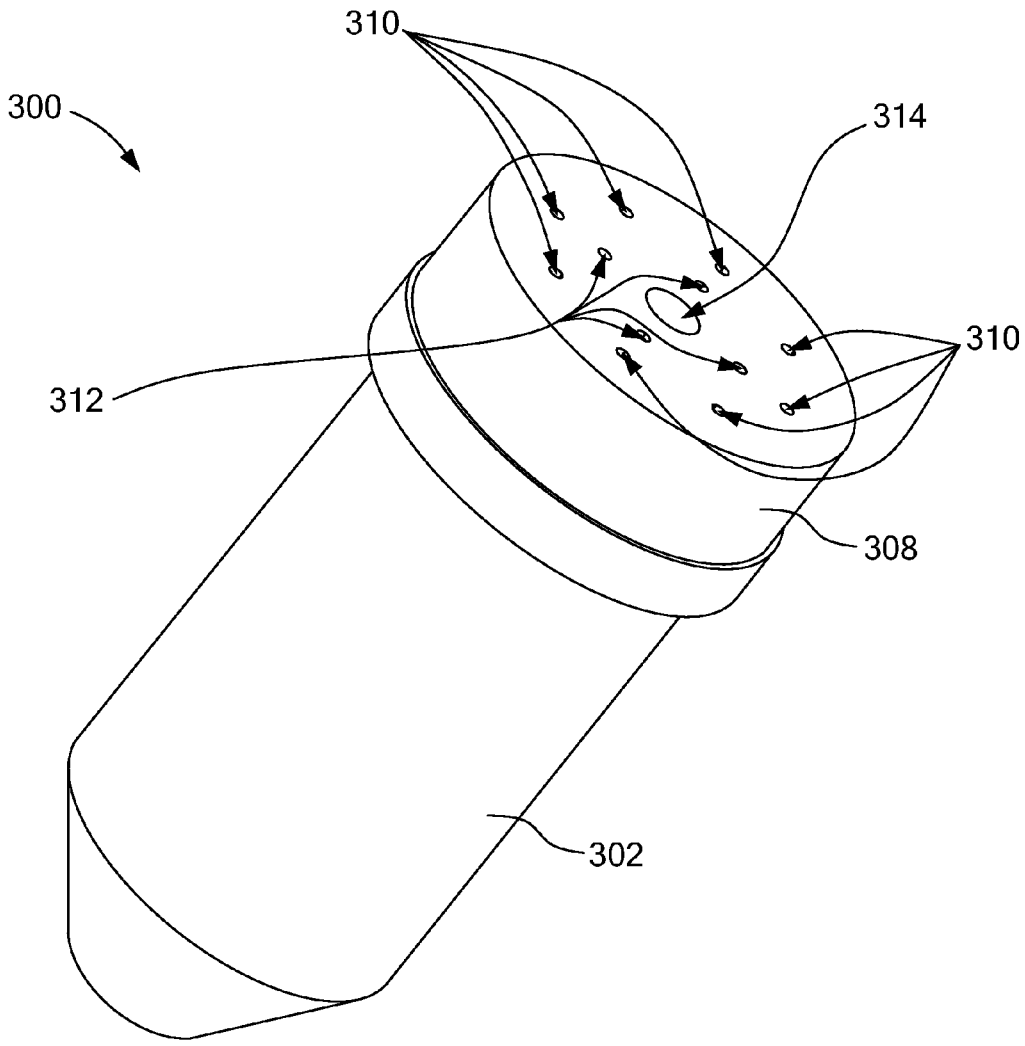
FIG. 34 is a perspective view of one form of a post-mix cutting tip constructed in accordance with the principles of the present disclosure.
Figure 35:
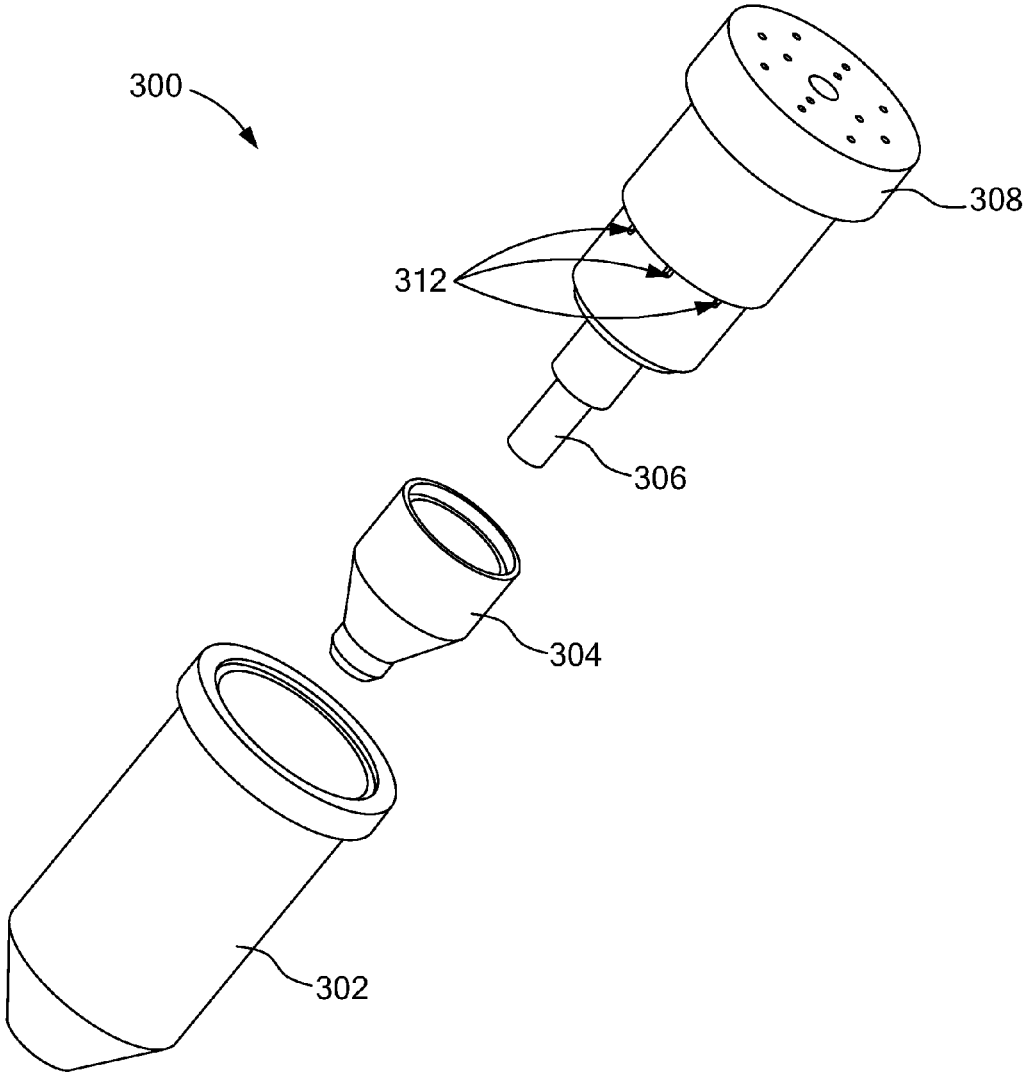
FIG. 35 is an exploded perspective view of the post-mix cutting tip in accordance with the principles of the present disclosure.
Figure 36:
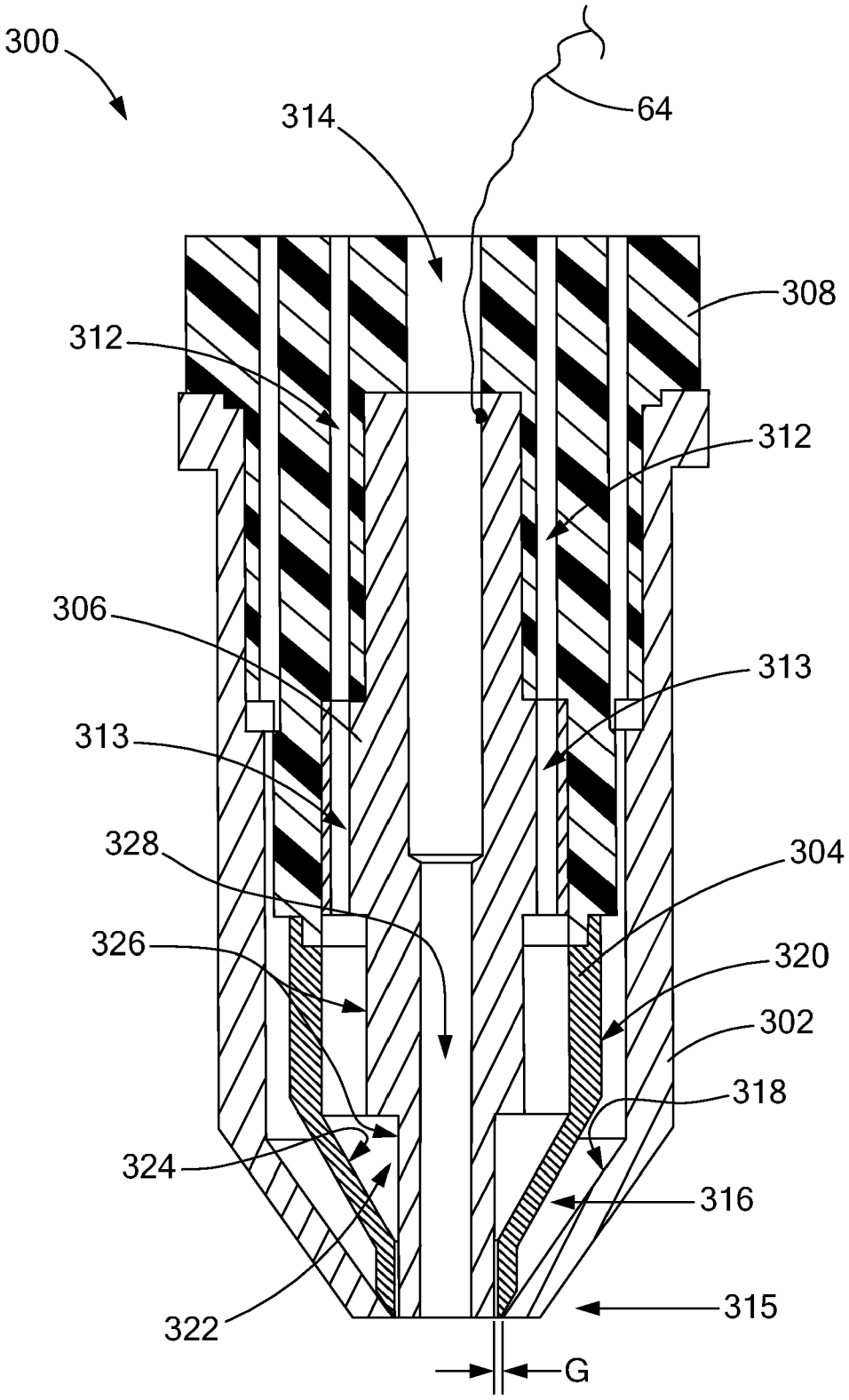
FIG. 36 is a cross-sectional view of the post-mix cutting tip in accordance with the principles of the present disclosure.

Referring now to FIGS. 34-36, one form of a post-mix cutting tip is illustrated and generally indicated by reference numeral 300. The post-mix cutting tip 300 comprises an outer shell 302, a cap 304, an inner tube 306, and an insert 308. The insert 308 includes a plurality of gas passageways 310, 312, and 314 for the flow of cutting oxygen, fuel gas, and preheat oxygen, respectively. Cutting oxygen gas passageways 310 are formed around the outer portion of the insert 308, fuel gas passageways 312 are formed around an inner portion of the insert 308, and the cutting oxygen gas passageway 314 takes the form of a central orifice extending through the center of the insert 308 and through the center of the inner tube 306. It should be understood that the number, size, and layout of gas passageways 310, 312, and 314 may be varied depending on cutting parameters/requirements while remaining within the scope of the present disclosure and that the configurations as illustrated herein are merely exemplary.

As shown in FIG. 36, the ignition wire 64 from the ignition system 60 (FIG. 3) extends through the central cutting oxygen gas passageway 314 and is in electrical contact with the inner tube 306, which is conductive and thus generates the spark for ignition of the gas cutting torch 20. More specifically, the spark is generated across a gap "G" between the inner tube 306 and the outer shell 302 at the distal end portion 315 of the post-mix cutting tip 300.

An annular preheat oxygen gas passageway 316 is defined between an inner surface 318 of the outer shell 302 and an outer surface 320 of the cap 304. This preheat oxygen gas passageway 316 is in fluid communication with the preheat oxygen gas passageways 310 formed through the insert 308, thus providing for the flow of preheat oxygen through the post-mix cutting tip 300. An annular fuel gas passageway 322 is formed between an inner surface 324 of the cap 304 and outer surfaces 326 of the inner tube 306. The annular fuel gas passageway 322 is in fluid communication with the fuel gas passageways 312 formed through the insert 308 and with the fuel gas passageways 313 formed through the inner tube 306, thus providing for the flow of fuel gas through the post-mix cutting tip 300. Advantageously, with fuel gas passageways 313 formed through the inner tube 306, the flow of fuel gas provides additional cooling to the inner tube 306 during operation. A central passageway 328 is formed through the inner tube 306 for the flow of cutting oxygen, which is in fluid communication with the cutting oxygen gas passageway 314 formed through the insert 308, thus providing for the flow of cutting oxygen through the post-mix cutting tip 300. In operation, the preheat oxygen, fuel gas, and cutting oxygen flow through separate gas passageways as set forth above and are not mixed together until they meet at the distal end portion 315 as shown. Accordingly, the gases are mixed at the distal end portion 315 to provide the post-mix feature, while the spark is generated across the gap "G," thereby providing both another safety feature and a convenience feature to the gas cutting torch 20.

It should be understood that the spacing between components of the post-mix cutting tip 300 and the angles of the cap 304 surfaces and outer shell 302 surfaces may be varied to achieve certain flame characteristics. Additionally, although the front faces of the inner tube 306 and the outer shell 302 are shown as being flush, they may also be offset from one another (in either direction) while remaining within the scope of the present disclosure.

In one form, the insert 308 is a high temperature plastic, such as PEEK (Polyetheretherketone) thermoplastic, and could alternately be a ceramic material, among others. The inner tube 306 is conductive and in one form is a brass alloy. Similarly, the outer shell 302 is conductive and is also a brass alloy. The cap 304 is a steel alloy in one form of the present disclosure. It should be understood that these materials are merely exemplary and that other materials may be employed while remaining within the scope of the present disclosure.

Figure 37:
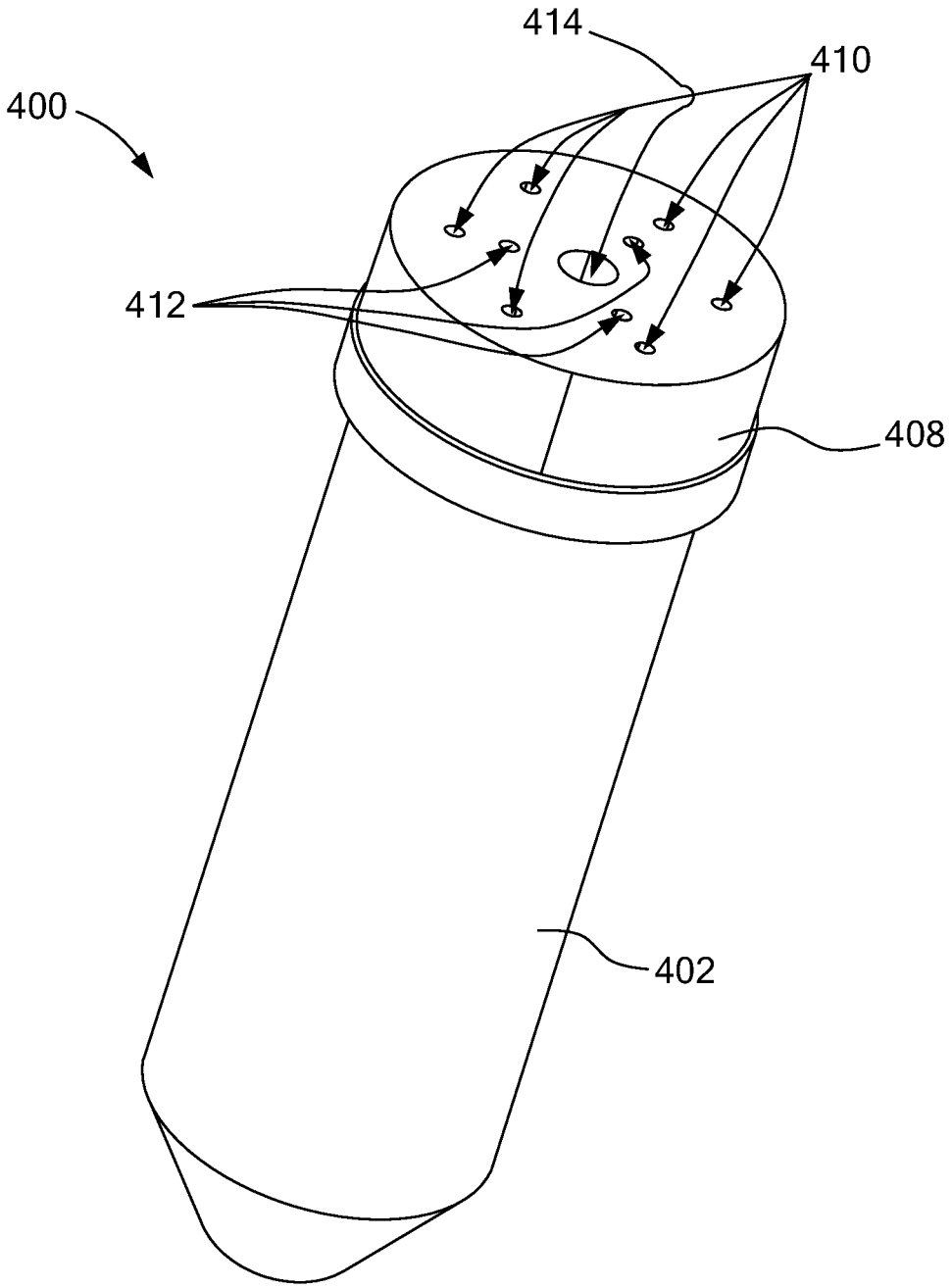
FIG. 37 is a perspective view of another form of a post-mix cutting tip constructed in accordance with the principles of the present disclosure.
Figure 38:
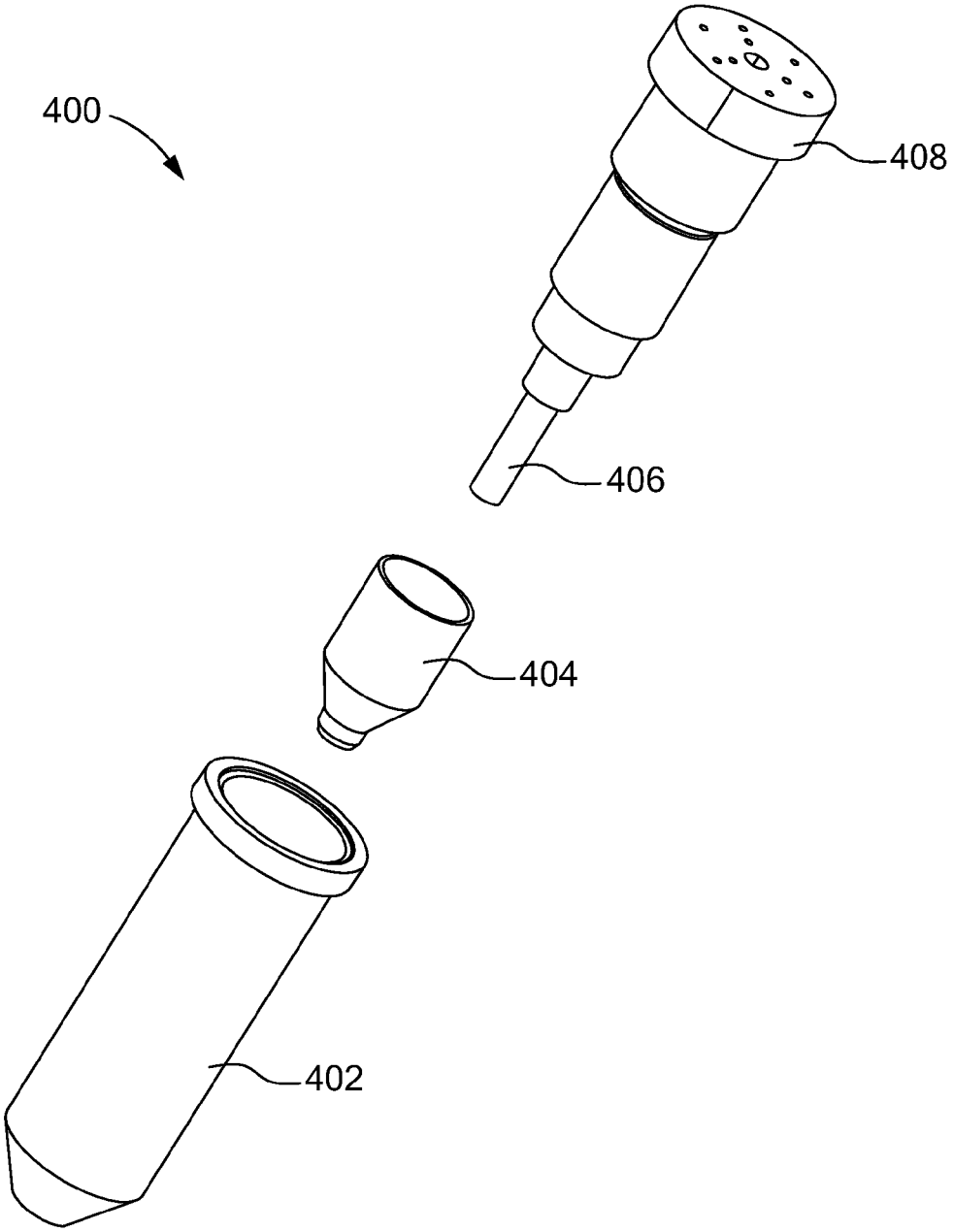
FIG. 38 is an exploded perspective view of the post-mix cutting tip of FIG. 37 in accordance with the principles of the present disclosure.
Figure 39:
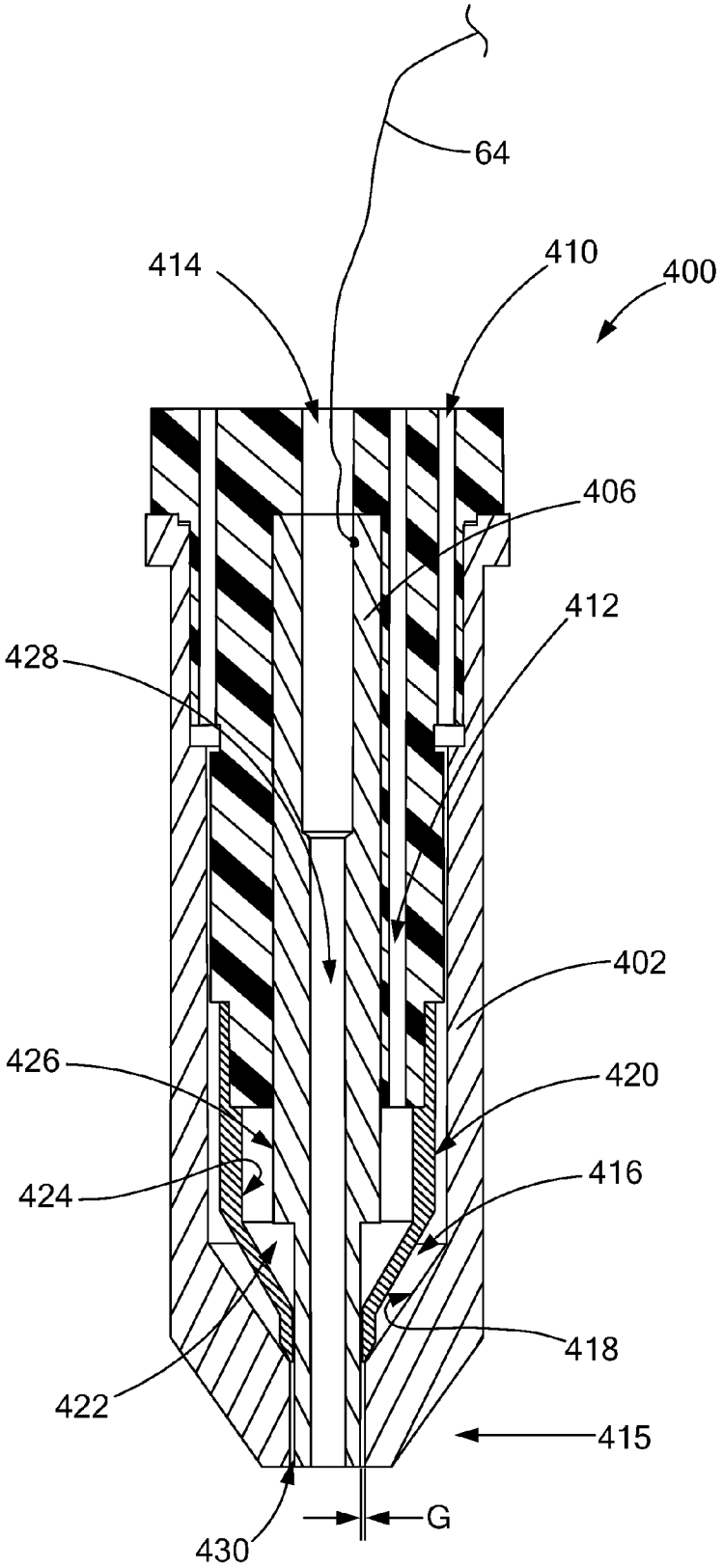
FIG. 39 is a cross-sectional view of the post-mix cutting tip of FIG. 37 in accordance with the principles of the present disclosure.

As shown in FIGS. 37-39, another form of a post-mix cutting tip is illustrated and generally indicated by reference numeral 400, in which the post-mixing occurs at a different location within the tip 400. The post-mix cutting tip 400 comprises an outer shell 402, a cap 404, an inner tube 406, and an insert 408. Similar to the previous embodiment, insert 408 includes a plurality of gas passageways 410, 412, and 414 for the flow of cutting oxygen, fuel gas, and preheat oxygen, respectively. Cutting oxygen gas passageways 410 are formed around the outer portion of the insert 408, fuel gas passageways 412 are formed around an inner portion of the insert 408, and the cutting oxygen gas passageway 414 takes the form of a central orifice extending through the center of the insert 408 and through the center of the inner tube 406. It should be understood that the number, size, and layout of gas passageways 410, 412, and 414 may be varied depending on cutting parameters/requirements while remaining within the scope of the present disclosure and that the configurations as illustrated herein are merely exemplary.

As shown in FIG. 39, the ignition wire 64 from the ignition system 60 (FIG. 3) extends through the central cutting oxygen gas passageway 414 and is in electrical contact with the inner tube 406, which is conductive and thus generates the spark for ignition of the gas cutting torch 20. More specifically, the spark is generated across a gap "G" between the inner tube 406 and the outer shell 402 at the distal end portion 415 of the post-mix cutting tip 400. Although an ignition wire 64 is shown as connecting the tips to the ignition system 60, it should be understood that other approaches, such as magnetic or optics by way of example, for electrically connecting the tip may be employed while remaining within the scope of the present disclosure.

An annular preheat oxygen gas passageway 416 is defined between an inner surface 418 of the outer shell 402 and an outer surface 420 of the cap 404. This preheat oxygen gas passageway 416 is in fluid communication with the preheat oxygen gas passageways 410 formed through the insert 408, thus providing for the flow of preheat oxygen through the post-mix cutting tip 400. An annular fuel gas passageway 422 is formed between an inner surface 424 of the cap 404 and outer surfaces 426 of the inner tube 406. The annular fuel gas passageway 422 is in fluid communication with the fuel gas passageways 412 formed through the insert 408, thus providing for the flow of fuel gas through the post-mix cutting tip 400. A central passageway 428 is formed through the inner tube 406 for the flow of cutting oxygen, which is in fluid communication with the cutting oxygen gas passageway 414 formed through the insert 408, thus providing for the flow of cutting oxygen through the post-mix cutting tip 400. In operation, the preheat oxygen, fuel gas, and cutting oxygen flow through separate gas passageways as set forth above and are not mixed together until they meet upstream of the distal end portion 315 as shown. The preheat oxygen and the fuel gas are mixed first and then this mixture travels through annular mixture passageway 430 towards the exit where cutting oxygen exits the post-mix cutting tip 400. Accordingly, the gases are mixed near the distal end portion 315 to provide the post-mix feature, while the spark is generated across the gap "G," thereby providing both another safety feature and a convenience feature to the gas cutting torch 20.

It should be understood that the spacing between components of the post-mix cutting tip 400 and the angles of the cap 404 surfaces and outer shell 402 surfaces may be varied to achieve certain flame characteristics. Additionally, although the front faces of the inner tube 406 and the outer shell 402 are shown as being flush, they may also be offset from one another (in either direction) while remaining within the scope of the present disclosure.

In one form, the insert 408 is a high temperature plastic, such as PEEK (Polyetheretherketone) thermoplastic, and could alternately be a ceramic material, among others. The inner tube 406 is conductive and in one form is a brass alloy. Similarly, the outer shell 402 is conductive and is also a brass alloy. The cap 404 is a steel alloy in one form of the present disclosure. It should be understood that these materials are merely exemplary and that other materials may be employed while remaining within the scope of the present disclosure.

It should also be appreciated from the present disclosure that the tips illustrated and described perform a dual-function, in that they distribute (and in one form mix) the fuel gas, the preheat oxygen, and the cutting oxygen, while also serving as an ignition source. Such a design is advantageous because the tip is a consumable component, and as such, is often replaced after repeated use. When the tip is replaced, the ignition source is also replaced, which results in a tip with improved performance. Moreover, the present disclosure is not to be viewed as limited to post-mixed cutting tips, and rather, tips that merely distribute gases but also function as an ignition source are also to be construed as falling within the scope of the present disclosure.

Operation

Referring back to FIG. 1, to operate the gas cutting torch 20, a user first adjusts the preheat oxygen and the fuel gas with preheat oxygen metering device 80 and preheat fuel metering device 82 located on the flow control unit 36. The user then activates the ignition trigger 32 to ignite the gas cutting torch 20. Once the gas cutting torch 20 is ignited, the user then depresses the cutting oxygen trigger 34 to adjust the amount of cutting oxygen for the desired flame/cutting characteristics. If the user wants to stop cutting for any reason, the ignition trigger 32 and the cutting oxygen trigger 34 are simply released, and the gas cutting torch 20 is shut off. To initiate operation again, the ignition trigger 32 is engaged, and then the cutting oxygen trigger 34 is depressed as needed during cutting. As such, the gas cutting torch 20 can be stopped and started with a single hand. Even if the gas cutting torch 20 is inadvertently dropped or the ignition trigger 32 is let go, operation is automatically shut off as previously set forth, thus providing another advantageous safety feature to the gas cutting torch 20.

The other safety features, namely, the check valves 210, 212, and 214 in the tube section 38, the flashback arrestors 192, 194, and 196 in the tube section, the post-mix cutting tips 300 and 400, the automatic shut-off features, the cutting oxygen interlock pin 135, and the sequencing of gas and ignition, provide an unprecedented level of safety not heretofore provided in gas cutting torches in the art. Along with the single-handed operation, the ergonomic features, and the interchangeability of components, (which is set forth in greater detail below), the gas cutting torch 20 according to the present disclosure provides significant improvements and advantages over gas cutting torches in the art. The gas cutting torch 20 can be used right where an operator needs to perform cutting operations and does not require a separate lighting step away from the workpiece and then moving the gas cutting torch 20 into place. Such prior art practice of lighting a torch away from a workpiece using a striker, and then moving the torch to the cutting location, can be dangerous, especially in tight quarters and/or where other items from the surrounding environment may become inadvertently damaged or destroyed during movement of the torch to the cutting location. As such, the gas cutting torch 20 according to the present disclosure provides increased efficiency to the operator as they are able to be more nimble and quick with their cutting operations.

Advantageously, each of the components of the gas cutting torch 20, namely, the flow control unit 36, the handle portion 22, the palm grip 240 of the handle portion 22, the tube section 38, and the tip seat 48 are interchangeably secured such that repair or replacement is easily accomplished. Depending on the needs of the end user and/or the application requirements, different configurations for each of these components may be desired, and thus the modular or interchangeable nature of these components provides additional flexibility and capability not seen in prior art gas cutting torches. Although mechanical fasteners are used to remove and replace these components, it should be understood that other forms of securing these components may be employed while remaining within the scope of the present disclosure. Additionally, components that are ambidextrous or that are tailored for either left handed or right handed operators may be employed while remaining within the scope of the present disclosure.

The description of the invention is merely exemplary in nature and, thus, variations that do not depart from the substance of the disclosure are intended to be within the scope of the invention. For example, the number of components as illustrated herein may be reduced through a "design-for-manufacturing and assembly" (DFMA) exercise, and thus combining or reducing the number of components shall be construed as falling within the scope of the present disclosure. Other such variations are not to be regarded as a departure from the spirit and scope of the invention. For example, it is contemplated that the gas cutting torch 20 may include an articulating head portion such that various angles can be achieved to accommodate cutting applications with limited access.

What is claimed is:

1. A gas torch comprising:

a handle portion including a distal end portion and a proximal end portion;

an auto-ignition system disposed within the gas torch;

a preheat oxygen conduit array extending through the gas torch;

a fuel gas conduit array extending through the gas torch;

a cutting oxygen conduit array extending through the gas torch;

at least one safety device disposed within the gas torch;

a cutting oxygen trigger;

an ignition trigger operable to start preheat gas flow and to ignite the gas torch, the ignition trigger configured for automatic disengagement of the auto-ignition system when the ignition trigger is released; and a purge selector operatively engaged with the ignition trigger such that the conduit arrays can be purged with their respective gases without engaging the ignition system, wherein gases flowing through the preheat oxygen conduit array, the fuel gas conduit array and the cutting oxygen conduit array are mixed outside the handle portion and near a distal end portion of the gas torch.

2. The gas torch according to claim 1, wherein the safety device comprises at least one check valve.

3. The gas torch according to claim 2, wherein the check valve is disposed within at least one of the preheat oxygen conduit array, the fuel gas conduit array, and the cutting oxygen conduit array.

4. The gas torch according to claim 1, wherein the safety device comprises at least one flashback arrestor.

5. The gas torch according to claim 4, wherein the flashback arrestor is disposed within at least one of the preheat oxygen conduit array, the fuel gas conduit array, and the cutting oxygen conduit array.

6. The gas torch according to claim 1, wherein the auto-ignition system comprises a piezoelectric igniter in communication with the ignition trigger and an ignition wire extending from the piezoelectric igniter to a tip.

7. The gas torch according to claim 1, wherein the ignition trigger comprises a latch that is configured to prevent inadvertent gas flow and ignition of the gas torch.

8. The gas torch according to claim 1 further comprising an interlock device configured to prevent inadvertent flow of cutting oxygen.

9. The gas torch according to claim 1 further comprising a biasing device that biases the ignition trigger in an off position.

10. The gas torch according to claim 1, wherein the ignition trigger further comprises a device for reducing an amount of force required to hold the ignition trigger in an on position.

11. The gas torch according to claim 1 further comprising a biasing device that biases the cutting oxygen trigger in an off position.

12. The gas torch according to claim 1 further comprising adjustment mechanisms such that upon start-up, fuel gas flows first, the ignition system is engaged, and then the preheat oxygen flows.

13. The gas torch according to claim 1 further comprising adjustment mechanisms such that upon shut-down, oxygen flow shuts off first, and then fuel gas is shut off.

14. The gas torch according to claim 1 further comprising a protective member disposed along a lower portion of a handle portion and configured to inhibit accidental engagement of the purge selector.

15. A gas torch comprising:

a handle portion including a distal end portion and a proximal end portion;

an auto-ignition system disposed within the gas torch;

a preheat oxygen conduit array extending through the gas torch;

a fuel gas conduit array extending through the gas torch;

a cutting oxygen conduit array extending through the gas torch;

a plurality of check valves disposed within the gas torch;

a plurality of flashback arrestors disposed within the gas torch;

a cutting oxygen trigger;

an ignition trigger operable to start preheat gas flow and to ignite the gas torch, the ignition trigger configured for automatic disengagement of the auto-ignition system when the ignition trigger is released; and a purge selector operatively engaged with the ignition trigger such that the conduit arrays can be purged with their respective gases without engaging the ignition system, wherein gases flowing through the preheat oxygen conduit array, the fuel gas conduit array and the cutting oxygen conduit array are mixed outside the handle portion and near a distal end portion of the gas torch.

16. The gas torch according to claim 15, wherein the ignition trigger comprises a latch that is configured to prevent inadvertent gas flow and ignition of the gas torch.

17. The gas torch according to claim 15 further comprising an interlock device configured to prevent inadvertent flow of cutting oxygen.

* * * * *